US011001053B2

(12) United States Patent
Noguchi et al.

(10) Patent No.: US 11,001,053 B2
(45) Date of Patent: May 11, 2021

(54) INK JET RECORDING METHOD AND INK JET RECORDING APPARATUS

(71) Applicant: CANON KABUSHIKI KAISHA, Tokyo (JP)

(72) Inventors: Mitsutoshi Noguchi, Kawaguchi (JP); Ryosuke Hirokawa, Kawasaki (JP); Toru Ohnishi, Yokohama (JP); Shingo Okushima, Kawasaki (JP); Yoichi Takada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/587,330

(22) Filed: Sep. 30, 2019

(65) Prior Publication Data

US 2020/0023635 A1 Jan. 23, 2020

Related U.S. Application Data

(62) Division of application No. 16/023,105, filed on Jun. 29, 2018, now Pat. No. 10,464,311.

(30) Foreign Application Priority Data

Jul. 4, 2017 (JP) ..... JP2017-131376

(51) Int. Cl.
*B41J 2/005* (2006.01)
*B41J 2/14* (2006.01)
(Continued)

(52) U.S. Cl.
CPC ..... *B41J 2/0057* (2013.01); *B41J 2/14088* (2013.01); *B41J 11/0015* (2013.01);
(Continued)

(58) Field of Classification Search
CPC ... B41J 2/01; B41J 2/175; B41J 2/0057; B41J 2/14088; B41J 2002/012; B41J 2002/14459; B41J 11/0015; B41M 7/00
See application file for complete search history.

(56) References Cited

U.S. PATENT DOCUMENTS 5,100,468 A 3/1992 Yuasa et al.
6,244,694 B1 * 6/2001 Weber ..... B41J 2/055 347/65
(Continued)

FOREIGN PATENT DOCUMENTS

DE 10 2014 221 9852 A1 4/2015
EP 3 012 105 A1 4/2016
(Continued)

OTHER PUBLICATIONS

Nov. 9, 2018 extended European Search Report, in European Patent Appln. No. 18181343.7.

*Primary Examiner* — Anh T Vo
(74) *Attorney, Agent, or Firm* — Venable LLP

(57) ABSTRACT

An ink jet recording method of the present invention includes: forming an ink image by ejecting an ink onto a transfer body with an ink jet head in which a recording element substrate provided with an element generating energy to be used for ejecting the ink, a pressure chamber including the element inside, and an ejection orifice ejecting the ink is provided, and the ink in the pressure chamber is circulated between the pressure chamber and the outside of the pressure chamber; and transferring the ink image onto a recording medium by bringing the recording medium into contact with the transfer body on which the ink image is formed, wherein a viscosity of the ink is 2 mPa·s or more to 20 mPa·s or less.

24 Claims, 9 Drawing Sheets

(51) Int. Cl.
*B41J 11/00* (2006.01)
*B41M 7/00* (2006.01)
*B41J 2/01* (2006.01)

(52) U.S. Cl.
CPC ..... *B41M 7/00* (2013.01); *B41J 2/01* (2013.01); *B41J 2002/012* (2013.01); *B41J 2002/14459* (2013.01)

(56) References Cited

U.S. PATENT DOCUMENTS 6,568,799 B1 * 5/2003 Yang ..... B41J 2/14 347/85
6,582,070 B2 6/2003 Takada et al.
6,932,465 B2 8/2005 Nito et al.
6,935,732 B2 8/2005 Takada et al.
7,354,145 B2 4/2008 Nito et al.
7,559,632 B2 7/2009 Kodama
8,562,119 B2 * 10/2013 Xie ..... B41J 2/1404 347/54
9,566,781 B2 * 2/2017 Takeuchi ..... B41M 5/0017
9,624,389 B2 4/2017 Chopra et al.
10,464,311 B2 * 11/2019 Noguchi ..... B41J 2/0057
2006/0221161 A1 * 10/2006 Hori ..... B41J 2/0057 347/103
2007/0188821 A1 8/2007 Kojima
2011/0228012 A1 9/2011 Yoshida et al.
2012/0113197 A1 5/2012 Kashu et al.
2014/0368593 A1 * 12/2014 Kanasugi ..... B41J 2/0057 347/103
2015/0175820 A1 6/2015 Breton et al.
2016/0185110 A1 * 6/2016 Masuda ..... B41J 2/04598 347/10
2016/0264808 A1 * 9/2016 Kido ..... C09D 11/106
2016/0303847 A1 10/2016 Soma et al.
2016/0369119 A1 12/2016 Landa et al.
2017/0217217 A1 8/2017 Miyakoshi et al.
2017/0232729 A1 8/2017 Hirokawa et al.
2017/0232762 A1 8/2017 Hirokawa et al.

FOREIGN PATENT DOCUMENTS

JP H07-32721 A 2/1995
JP 2007-118309 A 5/2007
WO 2011146069 A1 11/2011

* cited by examiner

INK JET RECORDING METHOD AND INK JET RECORDING APPARATUS

This application is a division of application Ser. No. 16/023,105 filed Jun. 29, 2018, which claims priority to Japanese Patent Application No. 2017-131376, filed Jul. 4, 2017.

BACKGROUND OF THE INVENTION

Field of the Invention

The present invention relates to an ink jet recording method and an ink jet recording apparatus.

Description of the Related Art

In an ink jet recording system, a liquid composition (an ink) containing a coloring material is directly or indirectly applied onto a recording medium such as paper, and thus, an image is formed. For example, an ink image is formed on a transfer body, and then, the ink image is transferred onto the recording medium such as paper, and thus, the image can be formed.

In Japanese Patent Application Laid-Open No. H07-32721, in order to improve transferability of the ink image from the transfer body to the recording medium, a method is proposed in which fine particles are contained in the ink, and the ink image is transferred by heating the transfer body to a minimum film forming temperature or higher of the fine particles.

On the other hand, in the ejection of the ink of an ink jet head, there is a case where a liquid component in the ink, such as moisture, is evaporated due to heat generated according to an ejection operation, heat according to temperature control of a recording element substrate or heat from the external environment in the vicinity of an ejection orifice, and thickening of the ink and a change in a coloring material concentration occur. For this reason, for example, in Japanese Patent Application Laid-Open No. 2007-118309, it is disclosed that the ejection operation of the ink is performed while circulating the ink through a flow path between the ejection orifice of the ink jet head and an element generating energy to be used for ejecting the ink (an energy-generating element). Accordingly, it is possible to replenish a new ink by discharging the ink in which the thickening and the change in the coloring material concentration occur, and thus, it is possible to suppress an ejection failure due to the thickening of the ink or color unevenness of an image due to the change in the coloring material concentration.

SUMMARY OF THE INVENTION

An object of the present invention is to provide an ink jet recording method and an ink jet recording apparatus, in which the transferability of the ink image from the transfer body to the recording medium is excellent, and an image with an excellent image quality can be formed.

According to an aspect of the present invention, provided is an ink jet recording method, including:

forming an ink image by ejecting an ink onto a transfer body with an ink jet head in which a recording element substrate provided with an element generating energy to be used for ejecting the ink, a pressure chamber including the element inside, and an ejection orifice ejecting the ink are provided, and the ink in the pressure chamber is circulated between the pressure chamber and the outside of the pressure chamber; and transferring the ink image onto a recording medium by bringing the recording medium into contact with the transfer body on which the ink image is formed, wherein a viscosity of the ink is 2 mPa·s or more to 20 mPa·s or less.

According to another aspect of the present invention, provided is an ink jet recording apparatus, including: a transfer body; an ink applying device including an ink jet head in which a recording element substrate provided with an element generating energy to be used for ejecting an ink, a pressure chamber including the element inside, and an ejection orifice ejecting the ink are provided, the ink in the pressure chamber is circulated between the pressure chamber and the outside of the pressure chamber, and an ink image is formed by ejecting the ink onto the transfer body; and a pressing member for transferring the ink image onto a recording medium by bringing the recording medium into contact with the transfer body on which the ink image is formed, in which a viscosity of the ink is 2 mPa·s or more to 20 mPa·s or less.

Further features of the present invention will become apparent from the following description of exemplary embodiments with reference to the attached drawings.

DESCRIPTION OF THE EMBODIMENTS

Figure 1:
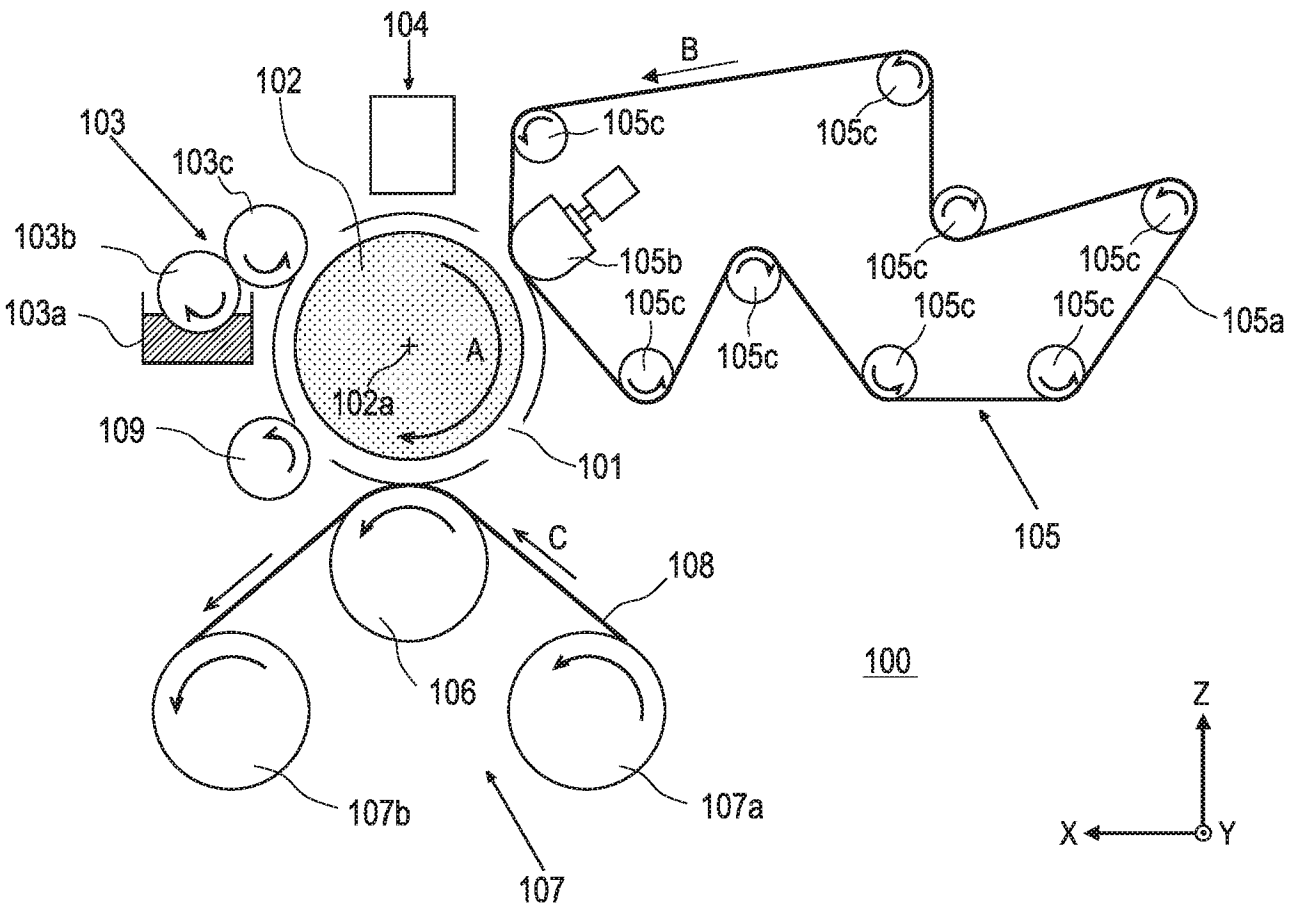
FIG. 1 is a schematic view illustrating an example of a configuration of an ink jet recording apparatus in one embodiment of the present invention.

In a case where the ink image is formed on the transfer body, and then, the ink image is transferred onto the recording medium, and thus, the image is formed, in the technologies described in Japanese Patent Application Laid-Open No. H07-32721 and Japanese Patent Application Laid-Open No. 2007-118309, the transferability of the ink image or an image quality to be obtained is not sufficient, and further improvement is desired.

An ink jet recording method according to the present invention includes the following steps. A step of forming an ink image by ejecting an ink onto a transfer body with an ink jet head. A step of transferring the ink image onto a recording medium by bringing the recording medium into contact with the transfer body on which the ink image is formed. Here, the ink jet head includes a recording element substrate provided with an element generating energy to be used for ejecting the ink (hereinafter, also referred to as an energy-generating element), a pressure chamber including the element inside and an ejection orifice ejecting the ink. The ink in the pressure chamber is circulated between the pressure chamber and the outside of the pressure chamber. In addition, a viscosity of the ink is 2 mPa·s or more to 20 mPa·s or less.

An ink jet recording apparatus according to the present invention has the following configurations. A transfer body. An ink applying device including an ink jet head forming an ink image by ejecting an ink onto the transfer body. A pressing member for transferring the ink image onto a recording medium by bringing the recording medium into contact with the transfer body on which the ink image is formed. Here, the ink jet head includes a recording element substrate provided with an energy-generating element, a pressure chamber including the element inside, and an ejection orifice ejecting the ink. The ink in the pressure chamber is circulated between the pressure chamber and the outside of the pressure chamber. In addition, a viscosity of the ink is 2 mPa·s or more to 20 mPa·s or less.

The present inventors have conducted intensive studies in order to improve the transferability of the ink image from the transfer body to the recording medium, and as a result thereof, have found that it is preferable to use an ink with a high viscosity in order to increase a cohesion force of the ink image on the transfer body. However, such an ink has low ejection properties from the ink jet head, and thus, is difficult to adapt. The present inventors have further conducted studies, and as a result thereof, have found that an ink with a high viscosity is used, and the ink in the pressure chamber of the ink jet head is circulated between the pressure chamber and the outside of the pressure chamber, and thus, the ejection properties of the ink can be maintained, and therefore, an image quality is improved, and the transferability of the ink image is improved. That is, in the present invention, the ink having a viscosity of 2 mPa·s or more to 20 mPa·s or less is ejected by using the ink jet head in which the recording element substrate provided with the energy-generating element, the pressure chamber and the ejection orifice are provided, and the ink in the pressure chamber is circulated between the pressure chamber and the outside of the pressure chamber, and thus, the ink image is formed.

Furthermore, a piezo type ink jet head and a thermal type ink jet head are general as the type of ink jet head. In particular, the energy-generating element is an exothermic element, and a thermal ink jet type ink jet head in which the ink is heated by the exothermic element, air bubbles are generated in the ink, and the ink is ejected, tends to have low adequacy with the ink with a high viscosity. However, in the present invention, in particular, in a case where the ink with a high viscosity is applied to the thermal ink jet type ink jet head, it is possible to maintain the ejection properties of the ink, and to improve the transferability of the ink image from the transfer body to the recording medium, and to improve a quality of an image to be obtained.

Hereinafter, an ink jet recording apparatus according to an embodiment of the present invention will be described with reference to the drawings.

FIG. 1 is a schematic view illustrating an example of a schematic configuration of a transfer type ink jet recording apparatus 100 of this embodiment. The recording device is a sheet-type ink jet recording apparatus in which an ink image is transferred onto a recording medium 108 through a transfer body 101, and thus, a recording matter is manufactured. In this embodiment, an X direction, a Y direction and a Z direction indicate a width direction (a total length direction), a depth direction and a height direction of the ink jet recording apparatus 100, respectively. The recording medium 108 is conveyed in the X direction.

As illustrated in FIG. 1, the ink jet recording apparatus 100 of the present invention includes the transfer body 101 supported on a support member 102, a reaction liquid applying device 103 applying a reaction liquid which reacts with a color ink, onto the transfer body 101, an ink applying device 104 including an ink jet head which applies a color ink onto the transfer body 101 onto which the reaction liquid is applied, and forms an ink image, which is an image of the ink, on the transfer body, a liquid absorbing device 105 absorbing a liquid component from the ink image on the transfer body, and a pressing member for transfer 106 for transferring the ink image on the transfer body, from which the liquid component is removed, onto the recording medium 108 such as paper. In addition, the ink jet recording apparatus 100 may include a transfer body cleaning member 109 cleaning a front surface of the transfer body 101 after the transfer, as necessary. It is obvious that the transfer body 101, the reaction liquid applying device 103, the ink jet head of the ink applying device 104, the liquid absorbing device 105 and the transfer body cleaning member 109 respectively have a length in the Y direction, only corresponding to the recording medium 108 to be used.

The transfer body 101 rotates around a rotation axis 102*a* of the support member 102, in a direction of an arrow A of FIG. 1. According to the rotation of the support member 102, the transfer body 101 is moved. The reaction liquid of the reaction liquid applying device 103 and the ink of the ink applying device 104 are sequentially applied onto the moving transfer body 101, and thus, the ink image is formed on the transfer body 101. The ink image formed on the transfer body 101 is moved to a position in contact with a liquid absorbing member 105*a* of the liquid absorbing device 105, according to the movement of the transfer body 101.

The transfer body 101 and the liquid absorbing device 105 are moved in synchronization with the rotation of the transfer body 101. The ink image formed on the transfer body 101 passes through a state of being in contact with the moving liquid absorbing member 105*a*. In this period, the liquid absorbing member 105*a* removes at least a part of the liquid component from the ink image on the transfer body. In the contact state, it is particularly preferable that the liquid absorbing member 105*a* is pressed against the transfer body 101 with a predetermined pressing force, from the viewpoint of allowing the liquid absorbing member 105*a* to effectively function.

The removal of the liquid component can be expressed from a different point of view as concentrating the ink constituting the first image formed on the transfer body. Concentrating the ink means that the proportion of the solid content contained in the ink, such as coloring material and resin, with respect to the liquid component contained in the ink increases owing to reduction in the liquid component.

Then, the ink image after removing the liquid, from which the liquid component is removed, is in a state where the ink is condensed, compared to an ink image before removing the liquid, and is further moved to a transfer unit in contact with the recording medium 108, which is conveyed by a recording medium conveying device 107, by the transfer body 101. While the ink image after removing the liquid is in contact with the recording medium 108, the pressing member for transfer 106 presses the transfer body 101, and thus, the ink image is transferred onto the recording medium 108. The ink image after the transfer, which is transferred onto the recording medium 108, is a reverse image of the ink image before removing the liquid and the ink image after removing the liquid.

Furthermore, in this embodiment, the reaction liquid is applied, and then, the ink is applied, and thus, the ink image is formed, on the transfer body, and thus, the reaction liquid remains in a non-image region where the ink image of the ink is not formed without reacting with the ink. In this device, the liquid absorbing member 105*a* removes the liquid component of the reaction liquid not only from the ink image, but also from an unreacted reaction liquid by being in contact therewith.

Therefore, in the above description, it is expressed that the liquid component is removed from the ink image, but it is not limitedly indicated that the liquid component is removed only from the ink image, and it is indicated that the liquid component is removed from the ink image at least on the transfer body.

Furthermore, the liquid component is not particularly limited insofar as having fluidity but not a certain shape, and having approximately a constant volume.

For example, water, an organic solvent or the like, contained in the ink or the reaction liquid is exemplified as the liquid component.

Each configuration of the ink jet recording apparatus of this embodiment will be described below.

<Transfer Body>

The transfer body 101 includes a surface layer including an ink image formation surface. Various materials such as a resin and ceramic, can be suitably used as a material of the surface layer, and a material having a high modulus of compressive elasticity is preferable from the viewpoint of durability or the like. Specifically, an acrylic resin, an acryl silicone resin, a fluorine-containing resin, and a condensate obtained by condensing a hydrolyzable organic silicon compound and the like are exemplified as the material of the surface layer. In order to improve wettability, transferability or the like of the reaction liquid, a surface treatment may be performed. A frame treatment, a corona treatment, a plasma treatment, a grinding treatment, a roughening treatment, an active energy ray irradiation treatment, an ozone treatment, a surfactant treatment, a silane coupling treatment and the like are exemplified as the surface treatment. A plurality of such treatments may be combined. In addition, the surface layer can be in an arbitrary shape.

Further, the condensate of the hydrolyzable organic silicon compound is preferable as the material of the surface layer, from the viewpoint of an image quality and transferability. Further, a condensate of a hydrolyzable organic silicon compound, which has a polymerization structure by a cation polymerization, a radical polymerization or the like, is preferable from the viewpoint of durability. It is assumed that the surface layer has a molecular structure having a siloxane bond derived from the hydrolyzable organic silicon compound, and thus, a component applied from the ink configuring the ink image effectively spreads on the ink image formation surface of the surface layer. In addition, it is assumed that the ink image is easily peeled off from the transfer body, and the transferability is improved.

The following compounds are exemplified as a specific example of the hydrolyzable organic silicon compound, but the present invention is not limited thereto. For example, glycidoxy propyl trimethoxy silane, glycidoxy propyl triethoxy silane, glycidoxy propyl methyl dimethoxy silane, glycidoxy propyl methyl diethoxy silane, glycidoxy propyl dimethyl methoxy silane, glycidoxy propyl dimethyl ethoxy silane, 2-(epoxy cyclohexyl) ethyl trimethoxy silane, 2-(epoxy cyclohexyl) ethyl triethoxy silane, compounds in which an epoxy group of the compounds described above is substituted with an oxetanyl group, acryloxy propyl trimethoxy silane, acryloxy propyl triethoxy silane, acryloxy propyl methyl dimethoxy silane, acryloxy propyl methyl diethoxy silane, acryloxy propyl dimethyl methoxy silane, acryloxy propyl dimethyl ethoxy silane, methacryloxy propyl trimethoxy silane, methacryloxy propyl triethoxy silane, methacryloxy propyl methyl dimethoxy silane, methacryloxy propyl methyl diethoxy silane, methacryloxy propyl dimethyl methoxy silane, methacryloxy propyl dimethyl ethoxy silane, methyl trimethoxy silane, methyl triethoxy silane, dimethyl dimethoxy silane, dimethyl diethoxy silane, trimethyl methoxy silane, trimethyl ethoxy silane, propyl trimethoxy silane, propyl triethoxy silane, hexyl trimethoxy silane, hexyl triethoxy silane, decyl trimethoxy silane, decyl triethoxy silane and the like are exemplified. In addition, in the compounds, a compound in which a hydrogen atom is arbitrarily substituted with a fluorine atom, can be used. Perfluoroalkyl silane (having 1 to 20 carbon atoms) and the like are exemplified as a specific example. That is, it is preferable that the front surface of the transfer body contains at least one of a silicone-based compound and a fluorine-based compound.

In addition, it is preferable that the transfer body includes a compressive layer having a function of absorbing a pressure variation. By disposing the compressive layer, the compressive layer is capable of absorbing the deformation, of dispersing the variation with respect to a local pressure variation and of maintaining excellent transferability even at the time of high-speed printing. For example, acrylonitrile-butadiene rubber, acryl rubber, chloroprene rubber, urethane rubber, silicone rubber and the like are exemplified as a material of the compressive layer. When the rubber material is molded, it is preferable that a predetermined amount of a vulcanizing agent, vulcanization accelerator or the like is compounded, and a foaming agent and a filler such as fine hollow particles or a dietary salt, are further compounded, as necessary, and thus, a porous material is formed. Accordingly, in various pressure variations, an air bubble portion is compressed along a volume change, and thus, it is possible to decrease the deformation in directions other than a compression direction, and to obtain more stable transferability and durability. A porous rubber material having a continuous pore structure in which pores are continuous with each other, and a porous rubber material having an independent pore structure in which pores are independent from each other are present, as a porous rubber material. In the present invention, any one structure may be used, or the structures may be used together.

Further, it is preferable that the transfer body includes an elastic layer between the surface layer and the compressive layer. Various materials such as a resin and ceramic, can be suitably used as a material of the elastic layer. Various elastomer materials and rubber materials are preferably used from the viewpoint of processing properties or the like. Specifically, for example, fluorosilicone rubber, phenyl silicone rubber, fluorine rubber, chloroprene rubber, urethane rubber, nitrile rubber, ethylene propylene rubber, natural rubber, styrene rubber, isoprene rubber, butadiene rubber, a copolymer of ethylene/propylene/butadiene, nitrile butadiene rubber and the like are exemplified. In particular, silicone rubber, fluorosilicone rubber and phenyl silicone rubber have small compression set, and thus, are preferable from the viewpoint of dimensional stability and durability. In addition, silicone rubber, fluorosilicone rubber and phenyl silicone rubber have a small change in a modulus of elasticity according to a temperature, and thus, are preferable from the viewpoint of transferability.

Various adhesive agent or double-faced tapes for fixing and retaining the respective layers configuring the transfer body (the surface layer, the elastic layer and the compressive layer) may be used between the respective layers configuring the transfer body. In addition, a reinforcement layer having a high modulus of compressive elasticity may be disposed in order to suppress lateral extension or to retain an elasticity at the time of mounting the transfer body on a device. In addition, a woven cloth may be used as the reinforcement layer. The transfer body can be produced by arbitrarily combining the respective layers according to the material.

The size of the transfer body can be freely selected according to a desired printing image size. The shape of the transfer body is not particularly limited, and specifically, the transfer body is in the shape of a sheet, a roller, a belt, an endless web and the like.

<Support Member>

The transfer body 101 is supported on the support member 102. Various adhesive agents or double-faced tapes may be used as a support method of the transfer body. Alternatively, an installation member formed of a metal, ceramic, a resin or the like is attached to the transfer body, and thus, the transfer body may be supported on the support member 102 by using the installation member.

The support member 102 is required to have a certain degree of structure strength, from the viewpoint of a conveying accuracy and durability. A metal, ceramic, a resin and the like are preferably used as a material of the support member. Among them, in particular, aluminum, iron, stainless steel, an acetal resin, an epoxy resin, polyimide, polyethylene, polyethylene terephthalate, nylon, polyurethane, silica ceramic and alumina ceramic are preferably used as a material of the support member, in order to improve control responsiveness by reducing inertia at the time of an operation, in addition to rigidity capable of withstanding pressurization at the time of the transfer or a dimensional accuracy. In addition, it is preferable that the materials are used in combination.

<Reaction Liquid Applying Device>

The ink jet recording apparatus of this embodiment includes the reaction liquid applying device 103 which applies the reaction liquid increasing the viscosity of the ink, onto the transfer body 101, in contact with the ink. A case is illustrated in which the reaction liquid applying device 103 of FIG. 1 is a gravure offset roller provided with a reaction liquid container 103*a* containing the reaction liquid, and reaction liquid applying members 103*b* and 103*c* applying the reaction liquid in the reaction liquid container 103*a* onto the transfer body 101.

The reaction liquid applying device may be any device which is capable of applying the reaction liquid onto the transfer body, and various devices known from the related art, can be suitably used. Specifically, a gravure offset roller, an ink jet head, a die coating device (a die coater), a blade coating device (a blade coater) and the like are exemplified. The reaction liquid of the reaction liquid applying device may be applied before the ink is applied or after the ink is applied, insofar as the reaction liquid can be mixed (react) with the ink on the transfer body. Preferably, the reaction liquid is applied before the ink is applied. The reaction liquid is applied before the ink is applied, and thus, it is possible to suppress breeding in which adjacent applied inks are mixed with each other, or beading in which the ink impacted first is attracted to the ink impacted later, at the time of ink jet type image recording.

<Reaction Liquid>

The reaction liquid aggregates components having an anionic group (a resin, a self-dispersible pigment and the like) in the ink, by being in contact with the ink, and contains a reactant. For example, a cationic component such as a polyvalent metal ion or a cationic resin, an organic acid and the like are exemplified as the reactant.

For example, a divalent metal ion such as $Ca^{2+}$, $Cu^{2+}$, $Ni^{2+}$, $Mg^{2+}$, $Sr^{2+}$, $Ba^{2+}$ and $Zn^{2+}$, or a trivalent metal ion such as $Fe^{3+}$, $Cr^{3+}$, $Y^{3+}$ and $Al^{3+}$ is exemplified as the polyvalent metal ion. In order to contain the polyvalent metal ion in the reaction liquid, a polyvalent metal salt configured by bonding a polyvalent metal ion and an anion together (may be a hydrate) can be used. For example, an inorganic anion such as $Cl^-$, $Br^-$, $I^-$, $ClO^-$, $ClO_2^-$, $ClO_3^-$, $ClO_4^-$, $NO_2^-$, $NO_3^-$, $SO_4^{2-}$, $CO_3^{2-}$, $HCO_3^-$, $PO_4^{3-}$, $HPO_4^{2-}$ and $H_2PO_4^-$; and an organic anion such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$ and $CH_3SO_3^-$ can be exemplified as the anion. In a case where the polyvalent metal ion is used as the reactant, it is preferable that a content (mass %) in terms of the polyvalent metal salt in the reaction liquid is 1.00 mass % or more to 10.00 mass % or less, on the basis of the total mass of the reaction liquid.

A reaction liquid containing an organic acid has buffer capacity in an acidic region (less than pH 7.0, and preferably pH 2.0 to 5.0), and thus, aggregates components in the ink by acidifying an anionic group of the component. For example, a monocarboxylic acid such as a formic acid, an acetic acid, a propionic acid, a butyric acid, a benzoic acid, a glycolic acid, a lactic acid, a salicylic acid, a pyrrole carboxylic acid, a furan carboxylic acid, a picolinic acid, a nicotinic acid, a thiophene carboxylic acid, a levulinic acid and a coumaric acid and salts thereof; a dicarboxylic acid such as an oxalic acid, a malonic acid, a succinic acid, a glutaric acid, an adipic acid, a maleic acid, a fumaric acid, an itaconic acid, a sebacic acid, a phthalic acid, a malic acid and a tartaric acid and salts or hydrogen salts thereof; a tricarboxylic acid such as a citric acid and a trimellitic acid and salts or hydrogen salts thereof; and a tetracarboxylic acid such as a pyromellitic acid and salts or hydrogen salts thereof, can be exemplified as the organic acid.

For example, a resin having a structure of primary amine to tertiary amine, a resin having a structure of a quaternary ammonium salt and the like can be exemplified as the cationic resin. Specifically, a resin having a structure of vinyl amine, allyl amine, vinyl imidazole, vinyl pyridine, dimethyl aminoethyl methacrylate, ethylene imine, guanidine or the like and the like can be exemplified. In order to increase solubility in the reaction liquid, the cationic resin and an acidic compound can be used together, or a quaternization treatment of the cationic resin can be performed. In a case where the cationic resin is used as the reactant, it is preferable that a content (mass %) of the cationic resin in the reaction liquid is 1.00 mass % or more to 10.00 mass % or less, on the basis of the total mass of the reaction liquid.

The same materials as water, a water-soluble organic solvent, the other additives and the like, which are exemplified as a material to be used in the ink, described below, can be used as components other than the reactant in the reaction liquid.

<Ink Applying Device>

The ink jet recording apparatus of this embodiment includes the ink applying device 104 applying the ink onto the transfer body 101. The reaction liquid and the ink are mixed with each other on the transfer body, the ink image is formed of the reaction liquid and the ink, and the liquid component is absorbed from the ink image by the liquid absorbing device 105.

In this embodiment, an ink jet head is used as the ink applying device applying the ink. For example, an ink jet head in which film boiling occurs in an ink by an electro-thermal converter such that air bubbles are formed, and thus, the ink is ejected, an ink jet head in which an ink is ejected by an electro-mechanical converter, an ink jet head in which an ink is ejected by using static electricity and the like are exemplified as the ink jet head. In this embodiment, in particular, the ink jet head using the electro-thermal converter is preferably used, from the viewpoint of printing at a high speed and a high density. In drawing, an image signal is received, and a necessary ink amount is applied to each position. A configuration of a specific ink jet head relevant to circulation or the like of the ink will be described below.

In this embodiment, the ink jet head is a full line head extending in the Y direction, and in the ink jet head, ejection orifices are arranged in a range of covering the width of an image recording region of the recording medium having a maximum usable size. The ink jet head includes an ink ejection surface in which the ejection orifice is opened, on a lower surface (the transfer body 101 side), and the ink ejection surface faces the front surface of the transfer body 101 with a minute gap (approximately several millimeters).

An ink applying amount can be expressed by an image concentration (duty) or an ink thickness, and in this embodiment, an average value obtained by multiplying the mass of each of the ink dots and the number of applications together, and by dividing the multiply result by a printing area, is set as the ink applying amount ($g/m^2$). Furthermore, a maximum ink applying amount in an image region indicates an ink applying amount which is applied in an area of at least 5 $mm^2$ or more, in a region used as information of the transfer body, from the viewpoint of removing the liquid component in the ink.

The ink applying device 104 may include a plurality of ink jet heads, in order to apply an ink of each color onto the transfer body. For example, in a case where each color image is formed by using a yellow ink, a magenta ink, a cyan ink and a black ink, the ink applying device is capable of including four ink jet heads respectively ejecting four types of inks described above, onto the transfer body. Four ink jet heads are arranged to be parallel in the X direction.

In addition, the ink applying device may include an ink jet head ejecting a clear ink which does not contain a coloring material or contains the coloring material at an extremely low ratio, and is substantially transparent. Then, the clear ink can be used for forming the ink image along with the reaction liquid and the color ink. For example, the clear ink can be used, in order to improve glossiness of an image. The resin component to be compounded may be suitably adjusted, and an ejection position of the clear ink may be controlled, such that the image after the transfer has glossy feeling. In a final recording matter, it is desirable that the clear ink is on the surface layer side, compared to the color ink, and thus, in a transfer type recording device, the clear ink is applied onto the transfer body 101 earlier than the color ink. For this reason, in a movement direction of the transfer body 101 facing the ink applying device 104, an ink jet head for a clear ink can be disposed on the upstream side from an ink jet head for a color ink.

In addition, the clear ink can be used in order to improve transferability of the ink image from the transfer body 101 to the recording medium, separately from the clear ink for glossiness. For example, the clear ink can be used as a transferability improving liquid to be applied onto the transfer body 101 by containing a component exhibiting pressure-sensitive adhesiveness, compared to the color ink, and by being applied to the color ink. For example, in the movement direction of the transfer body 101 facing the ink applying device 104, an ink jet head for a clear ink for improving transferability is disposed on the downstream side from the ink jet head for a color ink. Then, the color ink is applied onto the transfer body 101, and then, the clear ink is applied onto the transfer body after the color ink is applied, and thus, the clear ink exists on the uppermost surface of the ink image. In the transfer of the ink image with respect to the recording medium in the transfer unit, the clear ink on the front surface of the ink image pressure-sensitively adheres to the recording medium 108 with a certain degree of pressure-sensitive adhesion force, and thus, the ink image after removing the liquid is easily moved to the recording medium 108.

<Ink>

Each component of the ink which is applied to this embodiment will be described.

(Coloring Material)

A pigment or a dye can be used as the coloring material contained in the ink which is applied to this embodiment. The content of the coloring material in the ink is preferably 0.5 mass % or more to 15.0 mass % or less, and is more preferably 1.0 mass % or more to 10.0 mass % or less, on the basis of the total mass of the ink.

The type of pigment which can be used as the coloring material, is not particularly limited. An inorganic pigment such as carbon black and titanium oxide; and an organic pigment such as azo-based, phthalocyanine-based, quinacridone, isoindolinone-based, imidazolone-based, diketopyrrolopyrrole-based and dioxazine-based, can be exemplified as a specific example of the pigment. One type or two or more types of such pigments can be used, as necessary. A dispersion system of the pigment is not particularly limited. For example, a resin disperse pigment dispersed by a resin dispersant, a self-dispersible pigment in which a hydrophilic group such as an anionic group is bonded onto a front surface of particles of a pigment directly or through other atom groups and the like can be used. Naturally, a pigment of a different dispersion system can be used in combination.

A known resin dispersants used for an ink jet type aqueous ink, can be used as the resin dispersant for dispersing the pigment. Among them, an acryl-based water-soluble resin dispersant including a hydrophilic unit and a hydrophobic unit together on a molecular chain is preferably used in an aspect of this embodiment. A block copolymer, a random copolymer, a graft copolymer, a combination thereof and the like can be exemplified as the type of resin.

The resin dispersant in the ink may be in a state of being dissolved in a liquid medium, or may be in a state of being dispersed in the liquid medium as resin particles. In the present invention, the water-soluble resin does not form particles of which a particle diameter can be measured by a dynamic light scattering method, in a case where the resin is neutralized with an alkali equivalent to an acid value.

The hydrophilic unit (a unit having a hydrophilic group such as an anionic group), for example, can be formed by polymerizing a monomer having a hydrophilic group. An acidic monomer having an anionic group such as a (meth) acrylic acid and a maleic acid, an anionic monomer such as an anhydride or a salt of the acidic monomer and the like can be exemplified as a specific example of the monomer having the hydrophilic group. An ion such as lithium, sodium, potassium, ammonium and organic ammonium can be exemplified as a cation configuring the salt of the acidic monomer.

The hydrophobic unit (a unit not having hydrophilicity, such as an anionic group), for example, can be formed by polymerizing a monomer having a hydrophobic group. A monomer having an aromatic ring such as styrene, α-methyl styrene and benzyl (meth)acrylate; a monomer having an aliphatic group such as ethyl (meth)acrylate, methyl (meth) acrylate and butyl (meth)acrylate (that is, a (meth)acryl ester-based monomer) and the like can be exemplified as a specific example of the monomer having the hydrophobic group.

An acid value of the resin dispersant is preferably 50 mgKOH/g or more to 550 mgKOH/g or less, and is more preferably 100 mgKOH/g or more to 250 mgKOH/g or less. In addition, it is preferable that a weight average molecular weight of the resin dispersant is 1,000 or more to 50,000 or less. It is preferable that a content (mass %) of the pigment is 0.3 times or more to 10.0 times or less, at a mass ratio with respect to the content of the resin dispersant (Pigment/Resin Dispersant).

A self-dispersible pigment in which an anionic group such as a carboxylic acid group, a sulfonic acid group and a phosphonic acid group is bonded onto a front surface of particles of a pigment directly or through the other atom group (—R—), can be used as the self-dispersible pigment. The anionic group may be either an acid type or a salt type, and in a case where the anionic group is a salt type, the anionic group may be in either a state where a part of the anionic group is dissociated or a state the entire of the anionic group is dissociated. An alkali metal cation; ammonium; organic ammonium and the like can be exemplified as a cation which is a counter ion in a case where the anionic group is a salt type. In addition, a linear or branched alkylene group having 1 to 12 carbon atoms, an arylene group such as a phenylene group or a naphthylene group, an amide group, a sulfonyl group, an amino group, a carbonyl group, an ester group, en ether group and the like can be exemplified as a specific example of the other atom group (—R—). In addition, the other atom group may be a group in which the groups described above are combined.

The type of dye which can be used as the coloring material, is not particularly limited, but it is preferable to use a dye having an anionic group. Azo-based, triphenyl methane-based, (aza)phthalocyanine-based, xanthene-based, anthrapyridone-based and the like are exemplified as a specific example of the dye. One or two or more of such dyes can be used, as necessary.

In addition, in this embodiment, it is also preferable to use a so-called self-dispersible pigment which is capable of performing front surface modification with respect to the pigment and of dispersing the pigment itself, without using the dispersant.

(Resin Particles)

The ink which is applied to this embodiment, is capable of containing resin particles. It is not necessary that the resin particles contain a coloring material. The resin particles are preferable since the resin particles have an effect on improvement of image quality or fixing properties.

A material of the resin particles which can be used in this embodiment is not particularly limited, and a known resin can be suitably used. Specifically, resin particles configured of various materials such as olefin-based, polystyrene-based, urethane-based and acryl-based are exemplified. It is preferable that a weight average molecular weight (Mw) of the resin particles is in a range of 1,000 or more to 2,000,000 or less. A volume average particle diameter of the resin particles, which is measured by a dynamic light scattering method, is preferably 10 nm or more to 1,000 nm or less, and is more preferably 100 nm or more to 500 nm or less. A content (mass %) of the resin particles in the ink is preferably 1.0 mass % or more to 50.0 mass % or less, and is more preferably 2.0 mass % or more to 40.0 mass % or less, on the basis of the total mass of the ink.

(Aqueous Medium)

The ink which can be used in this embodiment, is capable of containing an aqueous medium such as water or a mixed solvent of water and a water-soluble organic solvent. Deionized water or ion exchange water is preferably used as water. It is preferable that a content (mass %) of water in the ink is 50.0 mass % or more to 95.0 mass % or less, on the basis of the total mass of the ink. In addition, it is preferable that a content (mass %) of the water-soluble organic solvent in the ink is 3.0 mass % or more to 50.0 mass % or less, on the basis of the total mass of the ink. A water-soluble organic solvent which can be used as an ink jet type ink, such as alcohols such as glycerin, (poly)alkylene glycols, glycol ethers, nitrogen-containing compounds, sulfur-containing compounds and the like can be used as the water-soluble organic solvent. One or two or more of such water-soluble organic solvents can be contained.

(Other Additives)

The ink which can be used in this embodiment, may contain various additives such as a defoaming agent, a surfactant, a pH adjuster, a viscosity adjuster, an antirust agent, an antiseptic agent, a mildewproofing agent, an antioxidant, a reduction inhibitor and a water-soluble resin, as necessary, in addition to the components described above.

(Viscosity)

A viscosity of the ink in the present invention, is 2 mPa·s or more to 20 mPa·s or less. In a case where the viscosity of the ink is less than 2 mPa·s, the transferability of the ink image from the transfer body to the recording medium decreases. On the other hand, in a case where the viscosity of the ink is more than 20 mPa·s, it is difficult to eject the ink, and an image quality decreases. The viscosity of the ink is preferably 5 mPa·s or more to 20 mPa·s or less, and is more preferably 10 mPa·s or more to 20 mPa·s or less. Furthermore, the viscosity of the ink is a value which is measured at 25° C. by a viscosimeter (Product Name of "RE80 type viscosimeter", manufactured by TOM SANGYO CO., LTD.).

<Liquid Absorbing Device>

In this embodiment, the liquid absorbing device 105 includes the liquid absorbing member 105*a*, and a pressing member 105*b* for absorbing a liquid, which presses the liquid absorbing member 105*a* against the ink image on the transfer body 101. Furthermore, the shape of the liquid absorbing member 105*a* and the pressing member 105*b* is not particularly limited. For example, as illustrated in FIG. 1, the pressing member 105*b* may be in a columnar shape, the liquid absorbing member 105*a* may be in a belt shape, and the liquid absorbing member 105*a* in the belt shape may be pressed against the transfer body 101 by the pressing member 105*b* in the columnar shape. In addition, the pressing member 105*b* may be in a columnar shape, the liquid absorbing member 105*a* is in a cylindrical shape formed on a circumferential surface of the pressing member 105*b* in the columnar shape, and the liquid absorbing member 105*a* in the cylindrical shape may be pressed against the transfer body by the pressing member 105*b* in the columnar shape. In this embodiment, in consideration of a space or the like in the ink jet recording apparatus, it is preferable that the liquid absorbing member 105*a* is in the belt shape. In addition, the liquid absorbing device 105 including the liquid absorbing member 105*a* in the belt shape, may include a extending member extending the liquid absorbing member 105*a*. In FIG. 1, a reference numeral of 105*c* is a extending roller as the extending member. In FIG. 1, the pressing member 105*b* is also a rotating roller member as with the extending roller, but is not limited thereto.

In the liquid absorbing device 105, the liquid absorbing member 105*a* including a porous body is pressed against the ink image by the pressing member 105*b* to be in contact with the ink image, and the liquid component contained in the ink image is absorbed by the liquid absorbing member 105*a*, and thus, the liquid component is reduced. Various methods known from the related art, for example, a heating method, a method of blowing low-humidity air, a decompressing method and the like may be used in combination, as a method of reducing the liquid component in the ink image, in addition to this method of bringing the ink image into contact with the liquid absorbing member. In addition, such methods are applied to the ink image after removing the liquid in which the liquid component is reduced, and thus, the liquid component may be further reduced.

<Liquid Absorbing Member>

In this embodiment, at least a part of the liquid component is removed from the ink image before removing the liquid, by being absorbed in contact with the liquid absorbing member including the porous body, and the content of the liquid component in the ink image is reduced. A contact surface of the liquid absorbing member with the ink image is set to a first surface, and the porous body is disposed on the first surface. It is preferable that the liquid absorbing member including the porous body is in a shape of absorbing the liquid by circulation, in which the liquid absorbing member is moved in tandem with the movement of the transfer body, is in contact with the ink image, and then, is again in contact with another ink image before removing the liquid at a predetermined cycle. For example, a shape such as an endless belt shape or a drum shape is exemplified.

(Porous Body)

In the porous body of the liquid absorbing member according to this embodiment, it is preferable that an average pore diameter on the first surface side is less than an average pore diameter on a second surface side opposite to the first surface. In order to prevent the coloring material in the ink from being attached to the porous body, it is preferable that a pore diameter is small, and the average pore diameter of the porous body on the first surface side, which is in contact with the ink image, is 10 nm or less. Furthermore, in this embodiment, the average pore diameter indicates an average diameter on a front surface of the first surface or the second surface, and for example, can be measured by a mercury intrusion method, a nitrogen adsorption method, SEM image observation and the like.

In addition, it is preferable that the thickness of the porous body is small in order to homogeneously have high air permeability. The air permeability can be indicated by a Gurley value defined in JIS P8117, and it is preferable that the Gurley value is 10 seconds or less. Here, in a case where the porous body is thin, there is a case where it is not possible to sufficiently ensure capacity necessary for absorbing the liquid component, and thus, it is possible to form the porous body with a multilayer configuration. In addition, in this embodiment, a layer of the liquid absorbing member in contact with the ink image may be the porous body, and a layer not in contact with the ink image may not be the porous body.

Next, an embodiment in a case where the porous body has the multilayer configuration, will be described. Here, a layer on a side in contact with the ink image will be described as a first layer, and a layer laminated on a surface opposite to a contact surface of the first layer with the ink image will be described as a second layer. Further, the multilayer configuration will be sequentially described in a lamination order from the first layer. Furthermore, herein, the first layer may be referred to as an "absorbing layer", and the second layer may be referred to as a "support layer".

[First Layer]

In this embodiment, a material of the first layer which is the porous body, is not particularly limited, and any of a hydrophilic material having a contact angle with respect to water of less than 90°, and a water-repellent material having a contact angle with respect to water of 90° or more, can be used.

The hydrophilic material is preferably selected from a single material such as cellulose or polyacryl amide, a composite material thereof and the like. In addition, the water-repellent material described below can be used by performing a hydrophilic treatment with respect to a front surface of the water-repellent material. A method such as sputter etching method, radioactive ray or $H_2O$ ion irradiation and excimer (ultraviolet ray) laser light irradiation is exemplified as the hydrophilic treatment. In a case of the hydrophilic material, it is preferable that the contact angle with respect to water is 60° or less. In a case of the hydrophilic material, there is an effect of sucking up a liquid, in particular, water, by a capillary force.

On the other hand, in order to suppress the attachment of the coloring material and to increase cleaning properties, a material of the first layer, a water-repellent material having low surface free energy, and in particular, a fluorine resin is preferable as a material of the first layer. Specifically, polytetrafluoroethylene (PTFE), polychlorotrifluoroethylene (PCTFE), polyvinylidene fluoride (PVDF), polyvinyl fluoride (PVF), a perfluoroalkoxy fluorine resin (PFA), an ethylene tetrafluoride.propylene hexafluoride copolymer (FEP), an ethylene.ethylene tetrafluoride copolymer (ETFE), an ethylene.chlorotrifluoroethylene copolymer (ECTFE) and the like are exemplified as the fluorine resin. One or two or more of such resins can be used, as necessary, and a plurality of layers may be laminated in the first layer. In a case of the water-repellent material, there is almost no effect of sucking up the liquid by the capillary force, and it takes time for sucking up the liquid at the time of initially being in contact with the ink image. For this reason, it is preferable that a liquid having a contact angle with respect to the first layer of less than 90° is immerse in the first layer. The liquid is applied from the first surface of the liquid absorbing member, and thus, is capable of being immersed in the first layer. It is preferable that the liquid is prepared by mixing a surfactant or a liquid having a small contact angle with respect to the first layer into water.

In this embodiment, the thickness of the first layer is preferably 50 μm or less, and is more preferably 30 μm or less. In this embodiment, the thickness is a value obtained by measuring thicknesses of arbitrary ten points with a direct advance type micrometer OMV_25 (Product Name, manufactured by Mitutoyo Corporation), and by calculating an average value thereof.

The first layer can be manufactured by a known manufacturing method of a thin porous film. For example, a resin material can be molded into a sheet-like material by a method such as extrusion molding, and then, can be stretched to a predetermined thickness. In addition, a plasticizer such as paraffin is added to a material at the time of the extrusion molding, the plasticizer is removed by heating or the like at the time of the extending, and thus, the porous film can be obtained. A pore diameter can be adjusted by suitably adjusting an added amount, a extending magnification or the like of the plasticizer to be added.

[Second Layer]

In this embodiment, it is preferable that the second layer is a layer having air permeability. Such a layer may be non-woven cloth of a resin fabric, or may be woven cloth. A material of the second layer is not particularly limited, but a material of which a contact angle with respect to the liquid component is identical or less than that of the first layer such that the liquid component absorbed on the first layer side does not flow back, is preferable. Specifically, the material is preferably selected from a single material such as polyolefin (polyethylene (PE), polypropylene (PP) or the like), polyurethane, polyamide such as nylon, polyester (polyethylene terephthalate (PET) or the like) and polysulfone (PSF) or a composite material thereof and the like. In addition, it is preferable that the second layer is a layer having a pore diameter greater than that of the first layer.

[Third Layer]

Non-woven cloth is preferable as a third layer and the subsequent layers, from the viewpoint of rigidity. The same material as that of the second layer is used as a material of the third layer.

[Other Members]

The liquid absorbing member may include a reinforcement member reinforcing a side surface of the liquid absorbing member, in addition to the porous body of the laminated structure described above. In addition, the liquid absorbing member may include a joining member at the time of linking end portions of the long sheet-like porous body in a longitudinal direction with each other to be a belt-like member. A non-porous tape material or the like can be used as such a member, and the member may be disposed in a position or at a cycle where the member is not in contact with the ink image.

[Manufacturing Method of Porous Body]

In a case where the porous body is formed by laminating the first layer and the second layer, a manufacturing method is not particularly limited, and the first layer and the second layer may overlap with each other, or the first layer and the second layer may adhere to each other by using a method such as adhesive agent lamination or heat lamination. It is preferable that the first layer and the second layer are interposed between heated rollers, and are heat-laminated while being pressurized, from the viewpoint of the air permeability. In addition, for example, a part of the first layer or the second layer may be melted by heating, and thus, the first layer or the second layer may adhere to each other. In addition, a fusion material such as a hot melt powder is interposed between the first layer and the second layer, and the first layer and the second layer may adhere to each other by heating. In a case where the third layer and the subsequent layers are laminated, the layers may be laminated at one time, or may be sequentially laminated. A lamination order is suitably selected.

(Pre-Treatment)

In this embodiment, it is preferable that a pre-treatment is performed by a pre-treatment unit (not illustrated in FIG. 1) applying a treatment liquid onto the liquid absorbing member, before the liquid absorbing member 105*a* including the porous body is in contact with the ink image. It is preferable that the treatment liquid used in this embodiment contains water and a water-soluble organic solvent. It is preferable that water is deionized by ion exchange or the like. In addition, the type of water-soluble organic solvent is not particularly limited, and any known organic solvent such as ethanol or isopropyl alcohol can be used. In the pre-treatment of the liquid absorbing member used in this embodiment, an application method is not particularly limited, but immersion or liquid droplet dropping is preferable.

(Pressurization Condition)

It is preferable that the pressure of the liquid absorbing member at the time of being in contact with the ink image on the transfer body is 2.9 $N/cm^2$ (0.3 $kgf/cm^2$) or more, since it is possible to perform solid-liquid separation with respect to the liquid component in the ink image for a shorter period of time, and to remove the liquid component from the ink image. Furthermore, herein, the pressure of the liquid absorbing member indicates a nip pressure between the transfer body and the liquid absorbing member, and is calculated by performing surface pressure measurement with a surface pressure distribution measuring device (Product Name: I-SCAN, manufactured by NITTA Corporation), and by dividing a load in a pressurization region by an area.

(Application Time)

It is preferable that a application time of bringing the liquid absorbing member 105*a* into contact with the ink image, is 50 ms or less, in order to further prevent the coloring material in the ink image from being attached to the liquid absorbing member. Furthermore, herein, the application time is a value calculated by dividing a pressure sensing width in the movement direction of the transfer body, by a movement speed of the transfer body, in the surface pressure measurement described above. Hereinafter, the application time will be referred to as liquid absorption nipping time.

Thus, the liquid component is absorbed on the transfer body 101, and the ink image in which the liquid component is reduced, is formed. Next, the ink image after removing the liquid is transferred onto the recording medium 108 in the transfer unit. A device configuration and condition at the time of the transfer will be described.

<Pressing Member for Transfer>

In this embodiment, the ink image after removing the liquid on the transfer body 101 is transferred onto the recording medium 108 which is conveyed by the recording medium conveying device 107, in contact with the recording medium 108 by the pressing member for transfer 106. The liquid component contained in the ink image on the transfer body 101 is removed, and then, is transferred onto the recording medium 108, and thus, it is possible to obtain a recording image in which curling, cockling or the like is suppressed.

The pressing member 106 is required to have a certain degree of structure strength, from the viewpoint of a conveying accuracy or durability of the recording medium 108. A metal, ceramic, a resin or the like is preferably used as a material of the pressing member 106. Among them, in particular, aluminum, iron, stainless steel, an acetal resin, an epoxy resin, polyimide, polyethylene, polyethylene terephthalate, nylon, polyurethane, silica ceramic and alumina ceramic are preferably used as the material of the pressing member 106, in order to improve control responsiveness by reducing inertia at the time of an operation, in addition to rigidity capable of withstanding pressurization at the time of the transfer or a dimensional accuracy. In addition, it is preferable that the materials are used in combination.

Pressing time for pressing the pressing member 106 against the transfer body in order to transfer the ink image after removing the liquid on the transfer body 101 onto the recording medium 108 is not particularly limited, but it is preferable that the pressing time is 5 ms or more to 100 ms or less, in order to perform excellent transfer, and not to impair the durability of the transfer body. Furthermore, the pressing time in this embodiment indicates time when the recording medium 108 is in contact with the transfer body 101, and is calculated by performing surface pressure measurement with a surface pressure distribution measuring device (Product Name: I-SCAN, manufactured by NITTA Corporation), and by dividing a length of a pressurization region in a conveying direction by a conveying speed.

In addition, a pressure of pressing the pressing member 106 against the transfer body 101 in order to transfer the ink image after removing the liquid on the transfer body 101 onto the recording medium 108 is not particularly limited, but is set to perform excellent transfer and not to impair the durability of the transfer body. For this reason, it is preferable that the pressure is 9.8 $N/cm^2$ (1 $kg/cm^2$) or more to 294.2 $N/cm^2$ (30 $kg/cm^2$) or less. Furthermore, the pressure in this embodiment indicates a nip pressure between the recording medium 108 and the transfer body 101, and is calculated by performing surface pressure measurement with a surface pressure distribution measuring device, and by dividing a load fin a pressurization region by an area.

A temperature when the pressing member 106 presses the transfer body 101 in order to transfer the ink image after removing the liquid on the transfer body 101 onto the recording medium 108 is not particularly limited, but it is preferable that the temperature is a glass transition point or more or a softening point or more of the resin component contained in the ink. In addition, it is preferable that a heating unit heating the ink image after removing the liquid on the transfer body 101, the transfer body 101 and the recording medium 108, is used for heating.

The shape of the pressing member 106 is not particularly limited, and for example, a roller-like pressing member is exemplified.

<Recording Medium and Recording Medium Conveying Device>

In this embodiment, the recording medium 108 is not particularly limited, and any known recording medium can be used. A long object wound into the shape of a roll, or a sheet-type object cut at a predetermined dimension is exemplified as the recording medium. Paper, a plastic film, a wooden board, a cardboard, a metal film and the like are exemplified as a material.

In addition, in FIG. 1, the recording medium conveying device 107 for conveying the recording medium 108 is configured of a recording medium feeding roller 107*a* and a recording medium winding roller 107*b*, but is not particularly limited thereto insofar as being capable of conveying the recording medium.

<Control System>

Figure 2:
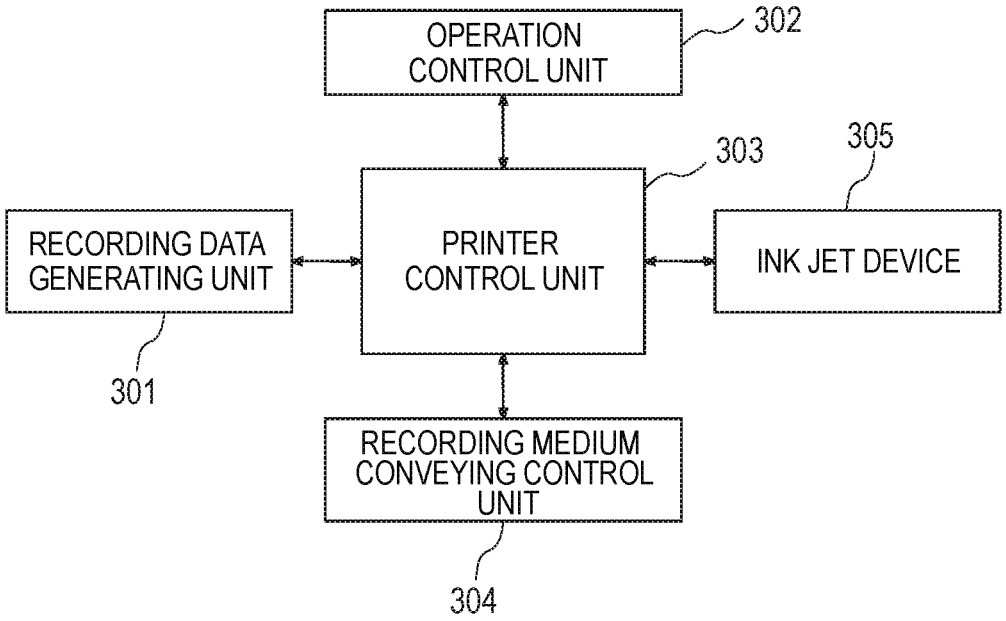
FIG. 2 is a block diagram illustrating a control system of the entire device in the ink jet recording apparatus illustrated in FIG. 1.

The ink jet recording apparatus of this embodiment includes a control system controlling each device. FIG. 2 is a block diagram illustrating a control system of the entire device in the ink jet recording apparatus illustrated in FIG. 1.

In FIG. 2, a reference numeral of 301 is a recording data generating unit such as an outside print server, a reference numeral of 302 is a operation control unit such as a operation panel, a reference numeral of 303 is a printer control unit for performing a recording process, a reference numeral of 304 is a recording medium conveying control unit for conveying the recording medium, and a reference numeral of 305 is an ink jet device for performing printing.

Figure 3:
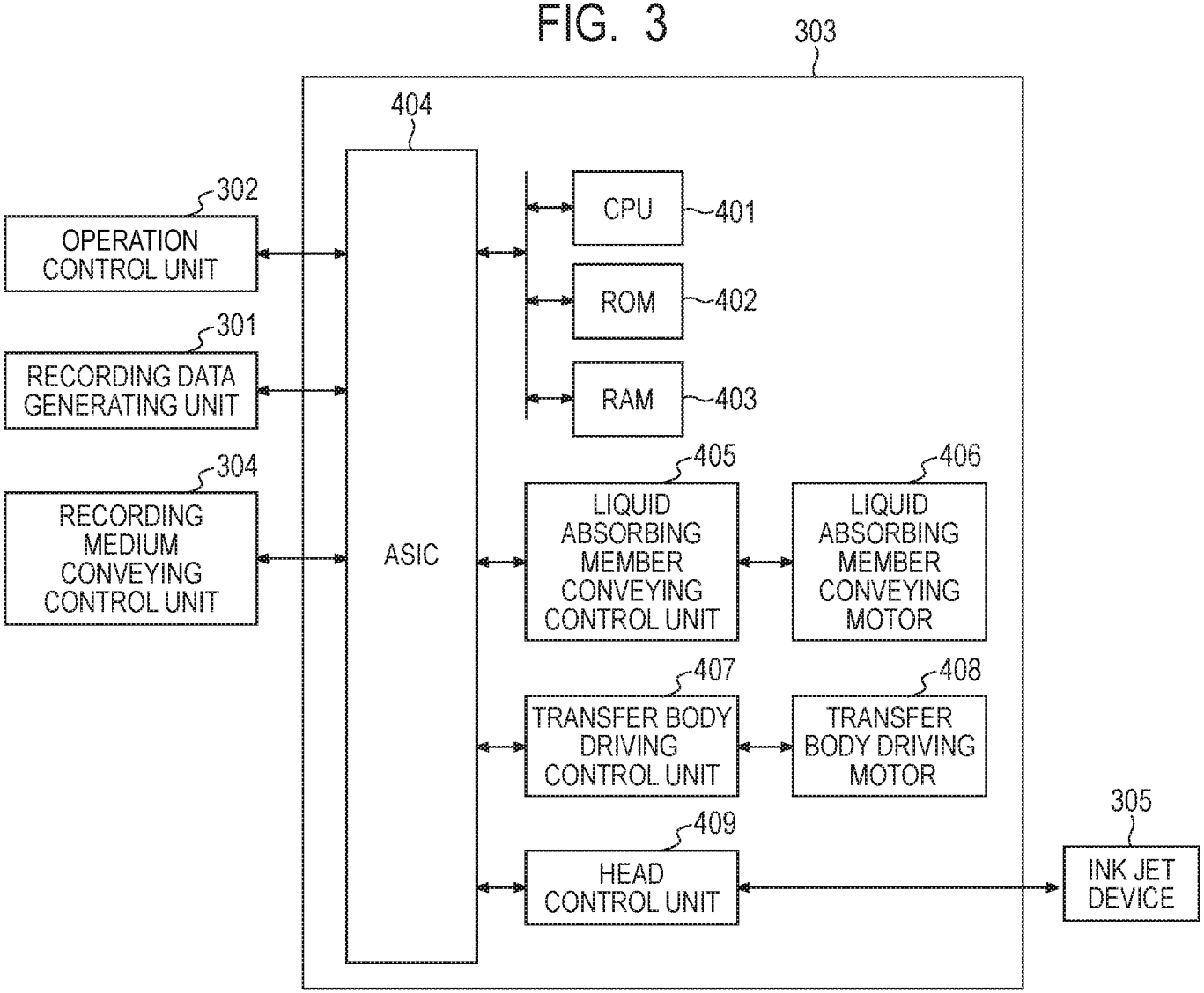
FIG. 3 is a block diagram illustrating a printer control unit in the ink jet recording apparatus illustrated in FIG. 1.

FIG. 3 is a block diagram of the printer control unit in the ink jet recording apparatus of FIG. 1. A reference numeral of 401 is a CPU controlling the entire printer, a reference numeral of 402 is a ROM for storing a control program of the CPU 401, and a reference numeral of 403 is a RAM for executing the program. A reference numeral of 404 is an application specific integrated circuit (ASIC) in which a network controller, a serial IF controller, a controller for generating head data, a motor controller and the like are built. A reference numeral of 405 is a liquid absorbing member conveying control unit for driving a liquid absorbing member conveying motor 406, and is command-controlled from the ASIC 404 through a serial IF. A reference numeral of 407 is a transfer body driving control unit for driving a transfer body driving motor 408, and similarly, is command-controlled from the ASIC 404 through the serial IF. A reference numeral of 409 is a head control unit, and performs final ejection data generation, driving voltage generation or the like of the ink jet device 305.

<Ink Jet Head>

Hereinafter, the ink jet head of this embodiment will be described by using the drawings. Here, the following description will not limit the scope of the present invention. In this embodiment, a thermal ink jet type is adopted in which air bubbles are generated by an exothermic element, which is an energy-generating element, and an ink is ejected, as an example, but an ink jet head can also be applied in which a piezo type and other various types are adopted. In this embodiment, the ink jet recording apparatus circulates the ink between a tank and the ink jet head, but the other embodiments may be considered.

(Basic Configuration)

In this embodiment, the number of ejection orifice rows which can be used per one color is 20 rows. For this reason, recording data is suitably sorted into plurality of ejection orifice rows, and recording is performed, and thus, high-speed recording can be performed. Further, even in a case where there is an ejection orifice which is not capable of ejecting the ink, the ink is interpolatively ejected form an ejection orifice on the other row, which is in a position corresponding to the movement direction of the transfer body with respect to the ejection orifice, and thus, reliability is improved, it is preferable for commercial printing or the like.

(Description of Circulation Route)

Figure 4:
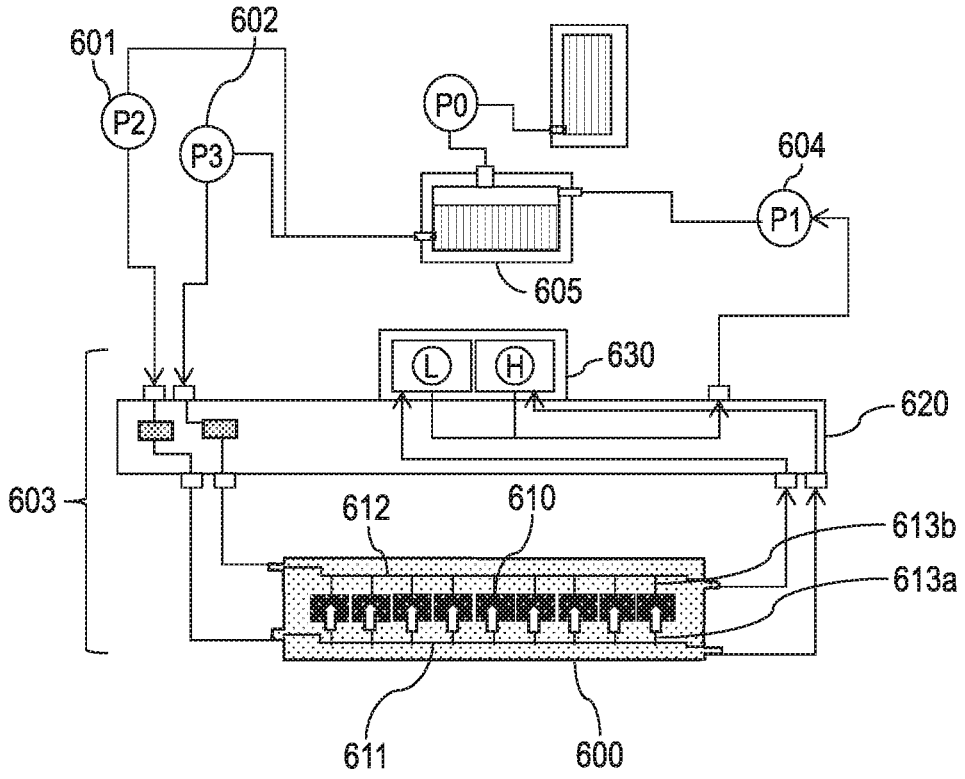
FIG. 4 is a schematic view illustrating a circulation route which is applied to the ink jet recording apparatus in one embodiment of the present invention.

FIG. 4 is a schematic view illustrating a circulation route which is applied to the ink jet recording apparatus of this embodiment. Both of two pressure adjustment mechanisms configuring a negative pressure control unit 630 are a mechanism controlling a pressure on an upstream side from the negative pressure control unit 630 to a variation in a certain range (a mechanism component having the same function as that of a so-called "back pressure regulator"), on the basis of a desired setting pressure. A second circulation pump 604 functions as a negative pressure source decompressing a downstream side of the negative pressure control unit 630. A first circulation pump (on a high pressure side) 601 and a first circulation pump (on a low pressure side) 602 are disposed on an upstream side of the ink jet head 603, and the negative pressure control unit 630 is disposed on a downstream side of the ink jet head 603.

Even in a case where there is a variation in a flow rate which is generated by a change in recording Duty at the time of performing recording by the ink jet head 603, the negative pressure control unit 630 operates such that a pressure variation on the upstream side thereof (that is, an ink ejection unit 600 side) is stabilized in a certain range, on the basis of a pressure set in advance. As illustrated in FIG. 4, it is preferable that the downstream side of the negative pressure control unit 630 is pressurized by the second circulation pump 604 through an ink supply unit 620. Thus, it is possible to suppress an influence of a hydraulic head pressure of a buffer tank 605 with respect to the ink jet head 603, and thus, it is possible to increase a selection width of the layout of the buffer tank 605 in the ink jet recording apparatus. For example, a hydraulic head tank which is disposed with a predetermined hydraulic head difference with respect to the negative pressure control unit 630, can also be applied, instead of the second circulation pump 604.

As illustrated in FIG. 4, the negative pressure control unit 630 includes two pressure adjustment mechanisms in which different control pressures are set. In two negative pressure adjustment mechanisms, a high-pressure setting side (in FIG. 4, described as H) and a low pressure side (in FIG. 4, described as L) are connected to a common supply flow path 611 and a common collection flow path 612 in the ink ejection unit 600 through the ink supply unit 620, respectively. The pressure of the common supply flow path 611 is set to be relatively higher than a pressure of the common collection flow path 612 by two negative pressure adjustment mechanisms, and thus, an ink flow flowing through an individual supply flow path 613*b* and the common collection flow path 612 from the common supply flow path 611 through an individual supply flow path 613*a* and an internal flow path of each recording element substrate 610 is generated (an arrow of FIG. 4).

(Description of Configuration of Ink Jet Head)

Figure 5A:
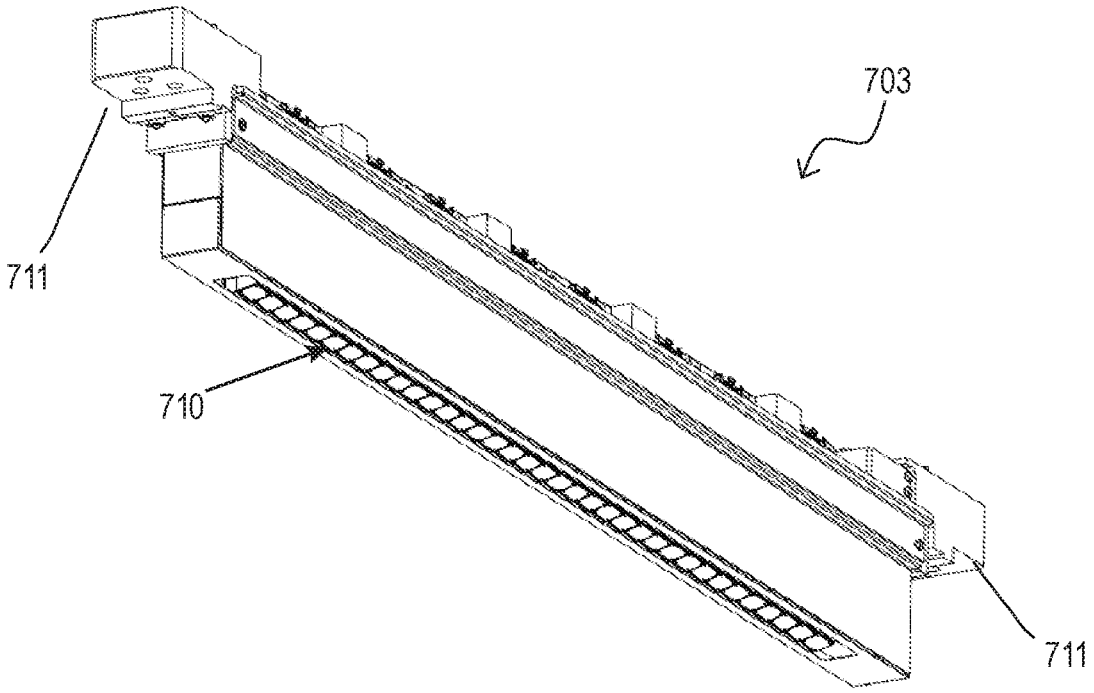
FIGS. 5A and 5B are perspective views illustrating an example of a configuration of an ink jet head in one embodiment of the present invention.
Figure 5B:
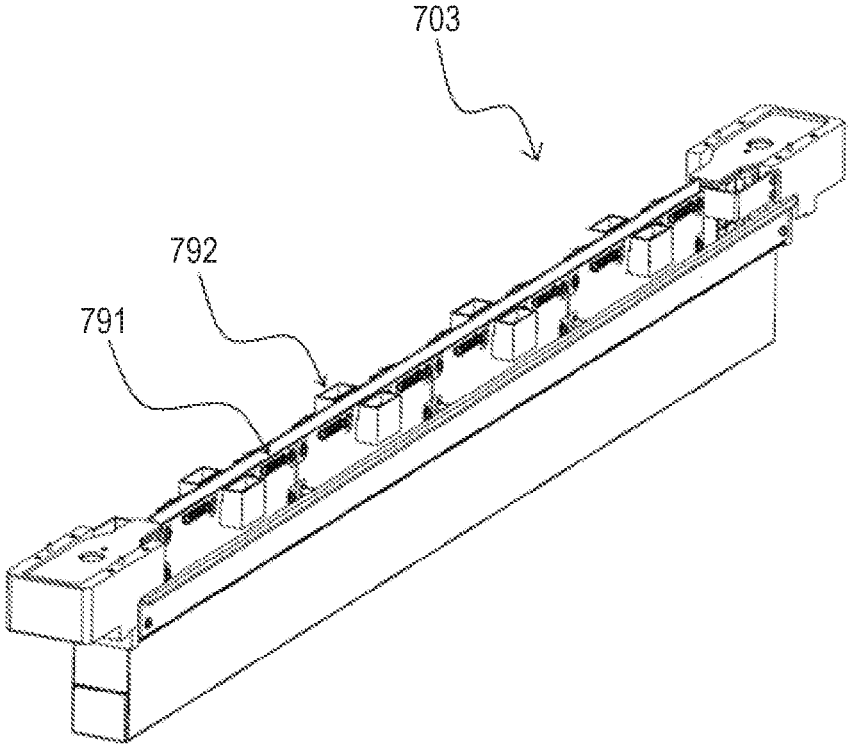

A configuration of the ink jet head according to this embodiment will be described. FIG. 5A and FIG. 5B are perspective views of a configuration of an ink jet head 703 according to this embodiment. The ink jet head 703 includes a plurality of recording element substrates 710 which are arranged on a straight line in a longitudinal direction of the ink jet head 703, and is an ink jet type line recording head in which recording can be performed by an ink of one color. The ink jet head 703 includes an ink connection portion 711, a signal input terminal 791 and a power supply terminal 792. The signal input terminal 791 and the power supply terminal 792 are disposed on both sides of the ink jet head 703. This is because a voltage decrease or a signal transmission lag, which are generated in a wiring portion disposed on the recording element substrate 710, is reduced.

Figure 6:
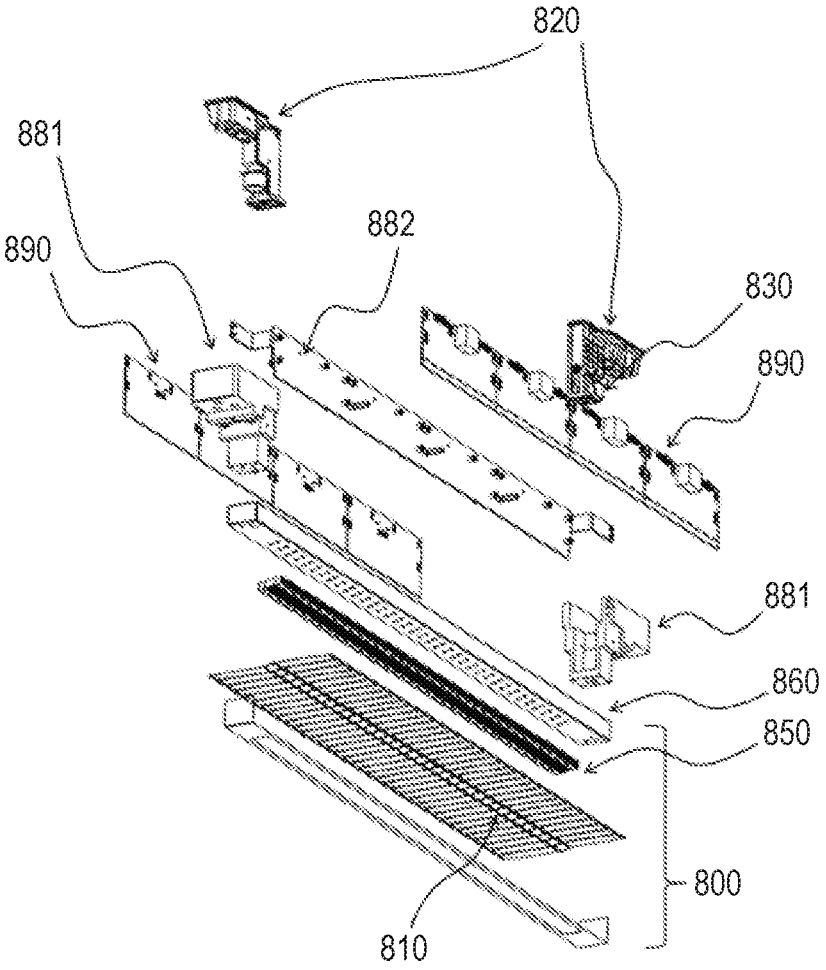
FIG. 6 is an exploded perspective view illustrating an example of the configuration of the ink jet head in one embodiment of the present invention.

FIG. 6 is an exploded perspective view of the ink jet head, and illustrates that each component or unit configuring the ink jet head is divided according to a function thereof. In the ink jet head of this embodiment, rigidity of the ink jet head is secured by a second flow path member 860 included in an ink ejection unit 800. An ink ejection unit support portion 881 in this embodiment is connected to both end portions of the second flow path member 860, the ink ejection unit 800 is mechanically bonded to a carriage of the ink jet recording apparatus, and positioning of the ink jet head is performed. An ink supply unit 820 including a negative pressure control unit 830, and an electrical wiring substrate 890 bonded to an electrical wiring substrate support portion 882, are bonded to the ink ejection unit support portion 881. Filters (not illustrated) are built in two ink supply units 820, respectively. Two negative pressure control units 830 are set to control a pressure with negative pressures which are different from each other and are relatively higher or lower. In addition, as illustrated in FIG. 6, in a case where the negative pressure control unit 830 on a high pressure side and the negative pressure control unit 830 on a low pressure side are disposed on both end portions of the ink jet head, respectively, the ink flows in the common supply flow path and the common collection flow path, extending in the longitudinal direction of the ink jet head, face each other. Thus, heat exchange is accelerated between the common supply flow path and the common collection flow path, and a temperature difference in two common flow paths is reduced, and thus, a temperature difference hardly occurs in the plurality of recording element substrates disposed along the common flow path, and recording unevenness due to the temperature difference hardly occurs.

Next, the detailed description of the flow path member of the ink ejection unit 800 will be described. As illustrated in FIG. 6, the flow path member is formed by laminating a first flow path member 850 and the second flow path member 860, and distributes the ink supplied from the ink supply unit 820 to each ejection module 810. In addition, the flow path member functions as a flow path member for returning the ink recirculated from the ejection module 810 to the ink supply unit 820. The second flow path member 860 of the flow path member is a flow path member in which a common supply flow path and a common collection flow path are formed, and has a function of mainly securing the rigidity of the ink jet head. For this reason, a material having sufficient corrosion resistance with respect to the ink and a high mechanical strength, is preferable as a material of the second flow path member 860. Specifically, SUS or Ti, alumina and the like can be preferably used.

Figure 7A:
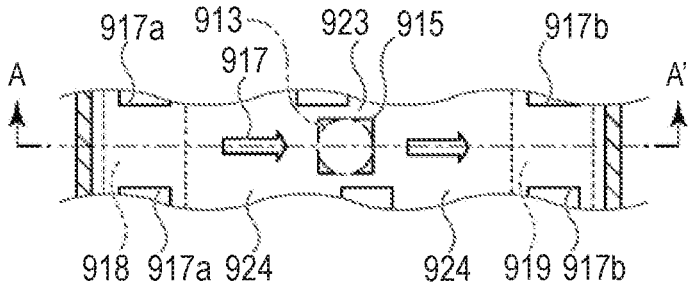
FIGS. 7A, 7B and 7C are diagrams illustrating an example of a structure of an ejection orifice of the ink jet head in one embodiment of the present invention, and an ink flow path in the vicinity thereof.
Figure 7B:
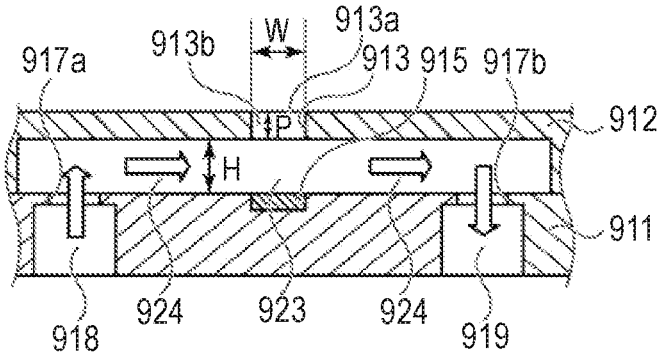
Figure 7C:
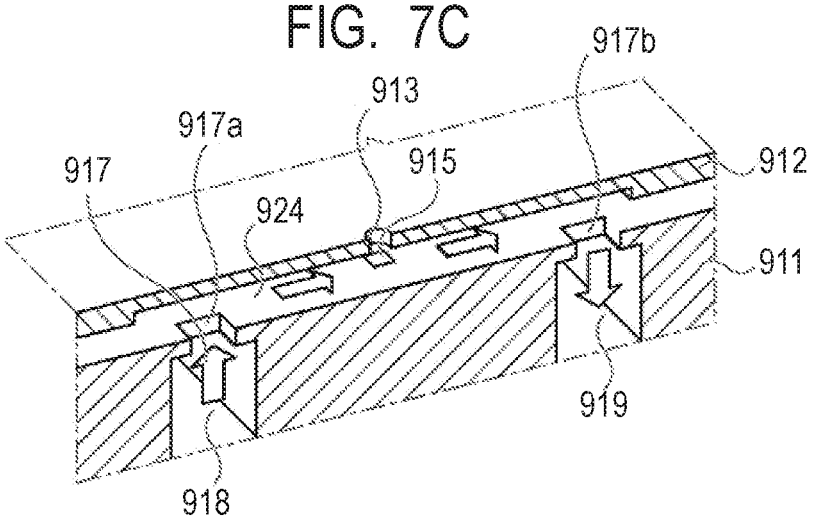

Next, in the ink jet head according to this embodiment described above, a structure of the ejection orifice and the vicinity thereof will be described. FIGS. 7A to 7C are diagrams illustrating the structure of the ejection orifice of the ink jet head according to this embodiment, and the ink flow path in the vicinity thereof. FIG. 7A is a plan view in which the ink flow path or the like is seen from a side from which the ink is ejected, FIG. 7B is a cross-sectional view along line A-A' of FIG. 7A, and FIG. 7C is a perspective view of a sectional surface of line A-A' of FIG. 7A.

As illustrated in FIGS. 7A to 7C, according to the circulation of the ink described above in FIG. 4 or the like, an ink flow 917 is generated in a pressure chamber 923 in which an energy-generating element 915 on a substrate 911 of the ink jet head is provided, and in a flow path 924 on the front and rear thereof. That is, the ink supplied from an ink supply route (a supply flow path) 918 through a supply port 917*a* of the substrate 911 passes through the flow path 924, the pressure chamber 923 and the flow path 924 by a differential pressure which causes ink circulation, and reaches an ink collection path (an outflow path) 919 through a collection port 917*b*.

Along with the ink flow described above, a space from the energy-generating element 915 to the ejection orifice 913 ejecting the ink thereon is filled with the ink at the time of non-ejection, and a meniscus of the ink (an ink interface 913*a*) is formed in the vicinity of an end portion of an ejection orifice 913 on an ejection direction side. Furthermore, in FIG. 7B, the ink interface is illustrated by a straight line (a plane surface) in order to simplify the ink interface, and the shape of the ink interface is determined according to a member forming a wall of the ejection orifice 913 and an ink surface tension, and in general, is a concave or convex curve (a curved surface). In a state where such a meniscus is formed, an electrothermal conversion element (a heater), which is the energy-generating element 915, is driven, and thus, it is possible to generate air bubbles in the ink by using heat to be generated, and to eject the ink from the ejection orifice 913. Furthermore, in this embodiment, an example is described in which the heater is applied as the energy-generating element, but the present invention is not limited thereto, and for example, various energy-generating elements such as a piezoelectric element can be applied. In this embodiment, the speed of the ink flow flowing through the flow path 924, for example, is 0.1 mm/s to 100 mm/s, and even in a case where an ejection operation is performed in a state where the ink flows, it is possible to set an influence on an impact accuracy or the like to be comparatively small.

Thus, the ejection operation of the ink is performed while circulating the ink in a pressure chamber and a flow path between the ejection orifice and the energy-generating element of the ink jet head. Accordingly, the moisture or the like of the ink is evaporated by heat according to the ejection operation, heat according to temperature control of the recording element substrate and heat from the external environment in the vicinity of the ejection orifice, and thus, it is possible to discharge an ink in which thickening or a change in a coloring material concentration occurs, and to replenish a new ink. As a result thereof, it is possible to suppress an ejection failure due to the thickening of the ink, or image color unevenness due to the change in the coloring material concentration.

(Relationship of P, W and H)

In the ink jet head according to this embodiment, a relationship in a height H of the flow path 924 and a thickness P of an orifice plate (a flow path formation member 912), and a length W (a diameter) of the ejection orifice can be defined as described below.

In FIG. 7B, the height of the flow path 924 on an upstream side is illustrated as H, on a lower end of a portion having the thickness P of the orifice plate of the ejection orifice 913 (hereinafter, referred to as an ejection orifice portion 913*b*) (a communication portion between an ejection orifice portion and a flow path). In addition, the length of the ejection orifice portion 913*b* is illustrated as P. Further, the length of the ejection orifice portion 913*b* in a flow direction of the ink in the flow path 924 is illustrated as W. In the ink jet head according to this embodiment, H can be 3 μm to 30 μm, P can be 3 μm to 30 μm, and W can be 6 μm to 30 μm.

Figure 8:
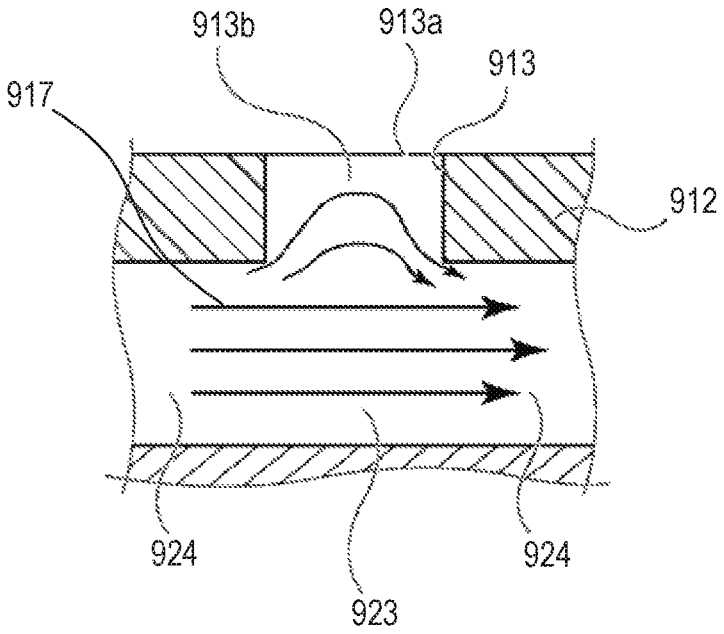
FIG. 8 is a cross-sectional view illustrating an example of a flow of an ink flow in the ink jet head in one embodiment of the present invention.

The ink jet head according to this embodiment is capable of having the following configuration, in order to suppress the thickening of the ink or the like due to the evaporation of the ink from the ejection orifice 913. FIG. 8 is a diagram illustrating an aspect of the flow of the ink flow 917 in the ejection orifice 913, the ejection orifice portion 913*b* and the flow path 924 when the ink flow 917 of the ink flow through the flow path 924 and the pressure chamber 923 of the ink jet head is in a normal state. Furthermore, in FIG. 8, a length of an arrow does not indicate the magnitude of the speed of the ink flow. In the ink jet head illustrated in FIG. 8, the height H of the flow path 924 is 14 μm, the length P of the ejection orifice portion 913*b* is 10 μm, and the length W (the diameter) of the ejection orifice is 17 μm. At this time, a flow when the ink flows from the ink supply route 918 to the flow path 924 at a flow rate of $1.26\times10^{-4}$ ml/min, is illustrated.

In this embodiment, the height H (μm) of the flow path 924, the length P (μm) of the ejection orifice portion 913*b* and the length W (μm) of the ejection orifice portion 913*b* in the flow direction of the ink have a relationship satisfying Expression (1) described below.

$$H^{-0.34}\times P^{-0.66}\times>1.5 \quad (1)$$

The ink jet head according to this embodiment satisfies Expression (1) described above, and thus, as illustrated in FIG. 8, the ink flow 917 flowing through the flow path 924 flows into the ejection orifice portion 913*b*, and reaches a position of at least half of the length P of the ejection orifice portion 913*b*, and then, returns again to the flow path 924. The ink returning to the flow path 924 flows through the common collection flow path described above, through the ink collection path 919. That is, at least a part of the ink flow 917 reaches a position of ½ or more of the ejection orifice portion 913*b* in a direction from the pressure chamber 923 towards the ink interface 913*a*, and then, returns to the flow path 924. According to such a flow, it is possible to suppress the thickening of the ink in a lot of regions in the ejection orifice portion 913*b*. Such an ink flow in the ink jet head is generated, and thus, the ink not only in the flow path 924 but also in the ejection orifice portion 913*b* is capable of flowing out to the flow path 924. As a result thereof, it is possible to suppress ink thickening or an increase in an ink coloring material concentration.

Figure 9:
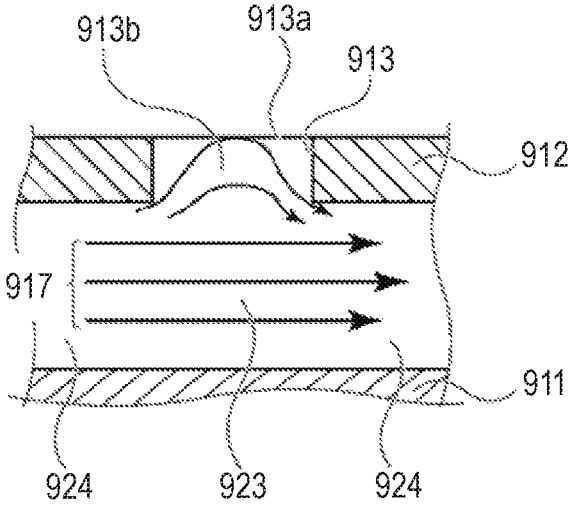
FIG. 9 is a cross-sectional view illustrating an example of the flow of the ink flow in the ink jet head in one embodiment of the present invention.

Further, the ink jet head according to this embodiment is capable of having the following configuration, in order to further reducing the influence of the thickening of the ink or the like due to the evaporation of the liquid component from the ejection orifice. As with FIG. 8, FIG. 9 is a diagram illustrating an aspect of the flow of the ink flow 917 in the ejection orifice 913, the ejection orifice portion 913*b* and the flow path 924 when the ink flow 917 of the ink flowing through the ink jet head is in the normal state. Furthermore, in FIG. 9, a length of an arrow does not correspond to the magnitude of the speed, and is a constant length regardless of the magnitude of the speed. FIG. 9 illustrates a flow when the ink flows into the flow path 924 from the ink supply route at a flow rate of $1.26\times10^{-4}$ ml/min, in the ink jet head having H of 14 μm, P of 5 μm and W of 12.4 μm.

In this embodiment, the height H of the flow path 924, the length P of the ejection orifice portion 913*b* and the length W of the ejection orifice portion 913*b* in the flow direction of the ink have a relationship satisfying Expression (2) described below.

$$H^{-0.34}\times P^{-0.66}\times W>1.7 \quad (2)$$

Accordingly, it is possible to further prevent the ink in which a change in a coloring material concentration occurs due to the evaporation of the ink from the ejection orifice, or a viscosity increases, from being accumulated in the vicinity of the ink interface 913*a* of the ejection orifice portion 913*b*, compared to the embodiment described above. That is, in this embodiment, as illustrated in FIG. 9, the ink flow 917 flowing through the flow path 924 flows into the ejection orifice portion 913*b*, and reaches the vicinity of the ink interface 913*a* (a meniscus position), and then, returns again to the flow path 924 through the ejection orifice portion 913*b*. The ink returning to the flow path 924 flows through the common collection flow path described above, through the ink collection path 919. According to such an ink flow, the ink not only in the ejection orifice portion 913*b* which is easily affected by the influence of the evaporation, but also in the vicinity of the ink interface 913*a* where the influence of the evaporation is particularly remarkable, is capable of flowing out to the flow path 924 without being accumulated in the ejection orifice portion 913*b*. As a result thereof, it is possible to allow the ink in a portion in the vicinity of the ejection orifice, which is particularly easily affected by the influence of the evaporation of the ink moisture or the like, to flow without being accumulated, and to suppress the ink thickening or the increase in the ink coloring material concentration. In this embodiment, it is possible to suppress an increase in a viscosity of at least a part of the ink interface 913*a*, and thus, it is possible to further reduce an influence of a change in an ejection speed or the like on the ejection, compared to a case where the viscosity of the entire ink interface 913*a* increases.

The ink flow 917 of this embodiment has a speed component (hereinafter, referred to as a positive speed component) in the flow direction of the ink in the flow path 924 (in FIG. 9, a direction from the left to the right), at least the central portion in the vicinity of the ink interface 913*a* (the center portion of the ejection orifice). Furthermore, herein, a flow mode in which the ink flow 917 has a positive speed component in at least the central portion in the vicinity of the ink interface 913*a*, will be referred to as a "flow mode A". In addition, a flow mode in which the ink flow 917 has a negative speed component in a direction opposite to that of the positive speed component, in the central portion of the ink interface 913*a*, will be referred to as a "flow mode B". According to the present invention, it is possible to provide an ink jet recording method and an ink jet recording apparatus, in which the transferability of the ink image from the transfer body to the recording medium is excellent, and an image with an excellent image quality can be formed.

EXAMPLES

Hereinafter, this embodiment will be described in more detail by using examples and comparative examples. The present invention is not limited by the following examples, unless the gist thereof is exceeded. Furthermore, in the description of the following examples, "part" is on a mass basis, unless otherwise noted.

Example 1

<Preparation of Reaction Liquid>

Components described below were mixed, and were sufficiently stirred stir, and then, were subjected to pressure filtration by a cellulose acetate filter having a pore size of 3.0 μm (manufactured by Advantech Co., Ltd.), and thus, a reaction liquid was prepared.

Levulinic Acid: 40.0 parts

Glycerin: 5.0 parts

Megafac F444: 1.0 parts (Product Name, a surfactant, manufactured by DIC Corporation)

Ion Exchange Water: 54.0 parts

<Preparation of Water Dispersion of Resin Particles 1>

Into a four-necked flask provided with a stirrer, a reflux cooling device and a nitrogen gas introduction tube, 18.0 parts of butyl methacrylate, 2.0 parts of a polymerization initiator (2,2'-azobis(2-methyl butyronitrile)) and 2.0 parts of n-hexadecane were put. Nitrogen gas was introduced into such a reaction system, and was stirred for 0.5 hours. 78.0 parts of an aqueous solution of an emulsifier (Product Name: NIKKOL BC15, manufactured by Nikko Chemicals Co., Ltd.) of 6.0 mass % was dropped into the flask, and was stirred for 0.5 hours. Next, an ultrasonic wave was applied for 3 hours by an ultrasonic irradiator, and thus, a mixture was emulsified. After that, a polymerization reaction was performed at 80° C. for 4 hours under a nitrogen atmosphere. The reaction system was cooled up to 25° C., and then, the component was filtered, and a suitable amount of pure water was added, and thus, a water dispersion of resin particles 1, in which the content of the resin particles 1 (a solid content) was 20.0 mass %, was prepared.

<Preparation of Aqueous Solution of Resin 1>

A styrene-acrylic acid ethyl-acrylic acid copolymer (a resin 1), in which an acid value was 150 mgKOH/g and a weight average molecular weight was 8,000, was prepared. 20.0 parts of the resin 1 was neutralized by potassium hydroxide equimolar to the acid value, and a suitable amount of pure water was added, and thus, an aqueous solution of the resin 1, in which the content of the resin 1 (a solid content) was 20.0 mass %, was prepared.

<Preparation of Pigment Dispersion K>

10.0 parts of a pigment (carbon black), 15.0 parts of the aqueous solution of the resin 1 and 75.0 parts of pure water were mixed. The mixture and 200 parts of zirconia beads having a diameter of 0.3 mm were put into a batch type vertical sand mill (manufactured by AIMEX CO., Ltd.), and were dispersed for 5 hours while performing water cooling. After that, coarse particles were removed by performing centrifugal separation, and pressure filtration was performed by a cellulose acetate filter having a pore size of 3.0 μm (manufactured by Advantech Co., Ltd.), and thus, a pigment dispersion K in which the content of the pigment was 10.0 mass %, and the content of the resin 1, which was a resin dispersant, was 3.0 mass %, was prepared.

<Preparation of Ink>

Components shown in Table 1 described below were mixed, and were sufficiently stirred, and then, were subjected to pressure filtration by a cellulose acetate filter having a pore size of 3.0 μm (manufactured by Advantech Co., Ltd.), and thus, a black ink was prepared. Furthermore, Acetylenol E100 (Product Name) is a surfactant manufactured by Kawaken Fine Chemicals Co., Ltd.

TABLE 1

| | Parts by mass |
|---|---|
| Pigment dispersion K | 20.0 |
| Water dispersion of resin particles 1 | 50.0 |
| Aqueous solution of resin 1 | 5.0 |
| Glycerin | 5.0 |
| Acetylenol E100 | 0.5 |
| Pure water | 19.5 |

<Production of Transfer Body A>

A porous layer formed of woven cloth and acrylonitrile.butadiene rubber was laminated, and silicone rubber into which hollow fine particles were mixed, was further laminated, and then, vulcanization was performed. Next, a mixture into which 7 parts of a carbon master batch, which was a high-concentration chromatic material for silicone rubber was mixed with respect to 100 parts of the silicone rubber, was laminated on a front surface of the porous layer, and vulcanization was performed, and thus, a base material layer was formed.

72 parts of Viscoat 8F (Product Name, manufactured by OSAKA ORGANIC CHEMICAL INDUSTRY LTD.), 3 parts of dimethyl aminomethyl methacrylate, 5 parts of Aronix M-305 (Product Name, manufactured by TOAGOSEI CO., LTD.), 20 parts of urethane oligomer (manufactured by TOAGOSEI CO., LTD., Number Average Molecular Weight: 10000) and 2 parts of Darocur 1173 (Product Name, manufactured by BASF SE) as a light initiator were compounded. The compounded components were diluted to be 10 mass % to 20 mass % by methyl isobutyl ketone, and thus, a coating liquid was obtained. Next, the coating liquid was applied onto the base material layer by spin coating, was subjected to film formation, and was exposed to UV light by using a UV lamp, and then, was heated at 120° C. for 2 hours, and thus, a surface layer A, which was a cured film, was formed. The thickness of the surface layer A was 5 μm. Accordingly, a transfer body A was obtained.

<Production of Transfer Body B>

Glycidoxy propyl triethoxy silane and methyl triethoxy silane were mixed at a molar ratio of 1:1, and heating reflux was performed in a water solvent for 24 hours or more by using a hydrochloric acid as a catalyst, and thus, a hydrolyzable condensate solution was obtained. The hydrolyzable condensate solution was diluted to be 10 mass % to 20 mass % by methyl isobutyl ketone, and a photocationic polymerization initiator SP150 (Product Name, manufactured by ADEKA Corporation) was added by 5 mass % with respect to the solid content, and thus, a coating liquid was obtained. A plasma treatment was performed with respect to a front surface of the base material layer, as a pre-treatment of the base material layer in the production of the transfer body A, and thus, coating properties and adhesiveness with respect to the surface layer were improved. Next, the coating liquid was applied onto the base material layer subjected to the pre-treatment, by spin coating, and was subjected to film formation. Next, UV light exposure was performed by using a UV lamp, and then, heating was performed at 120° C. for 2 hours, and thus, a surface layer B, which was a cured film, was formed. The thickness of the surface layer B was 5 μm. Accordingly, a transfer body B was obtained.

<Ink Jet Recording Apparatus and Image Formation>

An image was formed by using the transfer type ink jet recording apparatus illustrated in FIG. 1. The transfer body A produced by the method described above was used as the transfer body 101. The transfer body 101 is fixed onto a front surface of the support member 102.

The reaction liquid was applied onto the transfer body 101 by the reaction liquid applying device 103. After that, the ink was applied onto the transfer body 101 by the ink applying device 104, and thus, an ink image was formed. The ink jet head illustrated in FIGS. 5A and 5B was used as the ink applying device 104. The ink jet head includes the recording element substrate provided with the energy-generating element, the pressure chamber including the element inside, and the ejection orifice, and is configured such that the ink in the pressure chamber is circulated between the pressure chamber and the outside of the pressure chamber. A 100% solid pattern in which a solid image having a recording duty of 100% was formed in a range of 1 cm×1 cm, respectively, were used as a pattern of the ink image. Furthermore, in this ink jet recording apparatus, A condition in which one ink droplet of 4 ng is applied into a unit region of 1/1,200 inches×1/1,200 inches at a definition of 1,200 dpi×1,200 dpi, is defined as a recording duty of 100%.

Next, the liquid absorbing member 105*a* including the porous body was brought into contact with the ink image formed on the transfer body 101, and the liquid component was absorbed and removed from the ink image. A liquid absorbing member, which was a extending film formed of PTFE, in which a porous body having an average pore diameter of 0.4 μm and a thickness of 100 μm, and non-woven cloth (Product Name: HOP, manufactured by HIROSE PAPER MFG CO., LTD.) were laminated by heat lamination, was used as the liquid absorbing member 105*a*. The Gurley value of the liquid absorbing member 105*a* was 5 seconds. The liquid absorbing member 105*a* was immersed and osmosed in a treatment liquid formed of 95 parts of ethanol and 5 parts of water, before being brought into contact with the ink image, and then, the treatment liquid was substituted with 100 parts of water, and then, the liquid absorbing member 105*a* was used for removing the liquid. A pressure when the liquid absorbing member 105*a* was in contact with the ink image was set to be 2.9 N/cm$^2$ (0.3 kgf/cm$^2$) or more. After that, the recording medium 108 was brought into contact with the ink image after removing the liquid, and pressurization was performed such that the ink image after removing the liquid and the recording medium 108 were interposed between the support member 102 and the pressing member for transfer 106, and thus, the ink image after removing the liquid was transferred onto the recording medium 108, and the image was formed. Coated paper (trade name: Aurora Coat, manufactured by Nippon Paper Industries Co., Ltd., basis weight; 73.5 g/m2) was used as a recording medium 108.

<Image Quality Evaluation>

The ink image before the liquid removal formed on the transfer body was observed by an optical microscope, and an image area thereof was set to a basic image area. Next, the final image formed on the recording medium 108 was observed by an optical microscope, and the area was calculated, and was evaluated according to a change rate represented by the following expression, on the basis of the following standard. The results are shown in Table 3.

$$\text{Change Rate}(\%)=[(\text{Basic Image Area}-\text{Final Image Area})/(\text{Basic Image Area})]\times 100$$

A: The change rate is less than 0.5%.
B: The change rate is 0.5% or more and less than 1.0%.
C: The change rate is 1.0% or more and is less than 3.0%.
D: The change rate is 3.0% or more.

<Transferability Evaluation>

The transfer body before and after the transfer step was observed by an optical microscope, and the area of the ink image before the transfer and the residual area of the ink image after the transfer were calculated, and were evaluated according to a transfer rate with respect to the recording medium, represented by the following expression, on the basis of the following standard. The results are shown in Table 3.

$$\text{Transfer Rate}(\%)=100-(\text{Residual Area of Ink Image after Transfer})/(\text{Area of Ink Image before Transfer})\times 100$$

A: The transfer rate is 95% or more.
B: The transfer rate is 90% or more and less than 95%.
C: The transfer rate is 80% or more and less than 90%.
D: The transfer rate is less than 80%.

Examples 2 to 4 and Comparative Examples 1 to 3

The image was formed and evaluated by the same method as that in Example 1, except that the presence or absence of the ink circulation of the ink jet head, the viscosity of the ink, and the transfer body were changed as shown in Table 2. The results are shown in Table 3. Furthermore, in the ink jet head of Comparative Example 1, the ink in the pressure chamber is communicated with the outside only in the ejection orifice, and thus, is not circulated. In addition, the viscosity of the ink was adjusted by changing A compounding amount of the resin 1. A compounding amount of pure water was changed according to a change in the compounding amount of the resin 1. In Comparative Examples 1 and 3, good results of the image quality evaluation are not obtained, and thus transferability was not evaluated.

TABLE 2

| | Ink circulation | Viscosity of ink (mPa · s) | Transfer body |
|---|---|---|---|
| Example 1 | Present | 2 | A |
| Example 2 | Present | 5 | A |
| Example 3 | Present | 12.5 | B |
| Example 4 | Present | 20 | A |
| Comparative Example 1 | Absent | 12.5 | A |
| Comparative Example 2 | Present | 1 | A |
| Comparative Example 3 | Present | 30 | A |

TABLE 3

| | Image quality evaluation | Transferability evaluation |
|---|---|---|
| Example 1 | A | B |
| Example 2 | A | B |
| Example 3 | B | A |
| Example 4 | B | A |
| Comparative Example 1 | D | — |
| Comparative Example 2 | A | C |
| Comparative Example 3 | D | — |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131376, filed Jul. 4, 2017, which is hereby incorporated by reference herein in its entirety.

What is claimed is:

1. An ink jet recording method comprising:

(a) forming an ink image by ejecting an ink onto a transfer body with an ink jet head; and (b) transferring the ink image onto a recording medium by bringing the recording medium into contact with the transfer body on which the ink image is formed, wherein the ink jet head includes:

(i) an energy generating element configured to generate energy to eject the ink, (ii) a pressure chamber having the energy generating element inside, (iii) an ejection orifice configured to eject the ink, (iv) a plurality of supply paths configured to supply the ink to the pressure chamber, and (v) a plurality of collection paths configured to collect the ink from the pressure chamber, wherein a viscosity of the ink is 2 mPa·s or more to 20 mPa·s or less, wherein the ink is circulated between the pressure chamber and the outside of the pressure chamber, by a differential pressure between a pressure of the ink in the supply paths and a pressure of the ink in the collection paths, wherein the differential pressure is generated by a negative pressure control unit that includes two pressure adjustment mechanisms in which different control pressures are set, wherein a high-pressure setting side of the two pressure adjustment mechanisms is connected to a common supply flow path and a low-pressure setting side of the two pressure adjustment mechanisms is connected to a common collection flow path, wherein the common supply flow path is configured to supply the ink to the plurality of the supply paths, and wherein the common collection flow path is configured to collect the ink from the plurality of the collection paths.

2. The ink jet recording method according to claim 1, wherein a front surface of the transfer body contains at least one of a silicone-based compound and a fluorine-based compound.

3. The ink jet recording method according to claim 1, wherein the energy generating element is an exothermic element, and the ink jet head is a thermal ink jet type ink jet head in which the ink is heated by the energy generating element, air bubbles are generated in the ink, and the ink is ejected.

4. The ink jet recording method according to claim 1, further comprising applying a reaction liquid onto the transfer body, the reaction liquid increasing the viscosity of the ink through contacting with the ink.

5. The ink jet recording method according to claim 4, wherein the reaction liquid includes at least one of a polyvalent metal ion, a cationic resin, and an organic acid.

6. The ink jet recording method according to claim 1, further comprising removing at least a part of a liquid component from the ink image by bringing a liquid absorbing member into contact with the ink image on the transfer body.

7. The ink jet recording method according to claim 1, wherein the viscosity of the ink is 5 mPa·s or more to 20 mPa·s or less.

8. The ink jet recording method according to claim 1, wherein the transfer body includes a surface layer including a condensate of hydrolyzable organic silicon compound.

9. The ink jet recording method according to claim 1, wherein the transfer body includes a compressive layer including at least one of acrylonitrile-butadiene rubber, acryl rubber, chloroprene rubber, urethane rubber, and silicone rubber.

10. The ink jet recording method according to claim 1, wherein the transfer body includes an elastic layer including at least one of silicone rubber, fluorosilicone rubber, and phenyl silicone rubber.

11. The ink jet recording method according to claim 1, wherein the ink includes a pigment as a coloring material.

12. The ink jet recording method according to claim 1, wherein the ink includes water, and wherein a content of the water in the ink is 50.0 mass % or more to 95.0 mass % or less based on the total mass of the ink.

13. An ink jet recording apparatus comprising:

(a) a transfer body;

(b) an ink;

(c) an ink applying device including an ink jet head; and (d) a pressing member for transferring the ink image onto a recording medium by bringing the recording medium into contact with the transfer body on which the ink image is formed, wherein the ink jet head includes:

(i) an energy generating element configured to generate energy to eject the ink, (ii) a pressure chamber having the energy generating element inside, (iii) an ejection orifice configured to eject the ink, (iv) a plurality of supply paths configured to supply the ink to the pressure chamber, and (v) a plurality of collection paths configured to collect the ink from the pressure chamber, wherein a viscosity of the ink is 2 mPa·s or more to 20 mPa·s or less, wherein the ink jet recording apparatus further comprises a negative pressure control unit for circulating the ink between the pressure chamber and the outside of the pressure chamber, by generating a differential pressure between a pressure of the ink in the supply paths and a pressure of the ink in the collection paths, wherein the negative pressure control unit includes two pressure adjustment mechanisms in which different control pressures are set, wherein a high-pressure setting side of the two pressure adjustment mechanisms is connected to a common supply flow path and a low-pressure setting side of the two pressure adjustment mechanisms is connected to a common collection flow path, wherein the common supply flow path is configured to supply the ink to the plurality of the supply paths, and wherein the common collection flow path is configured to collect the ink from the plurality of the collection paths.

14. The ink jet recording apparatus according to claim 13, wherein a front surface of the transfer body contains at least one of a silicone-based compound and a fluorine-based compound.

15. The ink jet recording apparatus according to claim 13, wherein the energy generating element is an exothermic element, and the ink jet head is a thermal ink jet type ink jet head in which the ink is heated by the energy generating element, air bubbles are generated in the ink, and the ink is ejected.

16. The ink jet recording apparatus according to claim 13, further comprising a reaction liquid applying device applying a reaction liquid onto the transfer body, the reaction liquid increasing the viscosity of the ink through contacting with the ink.

17. The ink jet recording apparatus according to claim 16, wherein the reaction liquid includes at least one of a polyvalent metal ion, a cationic resin, and an organic acid.

18. The ink jet recording apparatus according to claim 13, further comprising a liquid absorbing device including a liquid absorbing member that removes at least a part of a liquid component from the ink image, by contact with the ink image on the transfer body.

19. The ink jet recording apparatus according to claim 13, wherein the viscosity of the ink is 5 mPa·s or more to 20 mPa·s or less.

20. The ink jet recording apparatus according to claim 13, wherein the transfer body includes a surface layer including a condensate of hydrolyzable organic silicon compound.

21. The ink jet recording apparatus according to claim 13, wherein the transfer body includes a compressive layer including at least one of acrylonitrile-butadiene rubber, acryl rubber, chloroprene rubber, urethane rubber, and silicone rubber.

22. The ink jet recording apparatus according to claim 13, wherein the transfer body includes an elastic layer including at least one of silicone rubber, fluorosilicone rubber, and phenyl silicone rubber.

23. The ink jet recording apparatus according to claim 13, wherein the ink includes a pigment as a coloring material.

24. The ink jet recording apparatus according to claim 13, wherein the ink includes water, and wherein a content of the water in the ink is 50.0 mass % or more to 95.0 mass % or less based on the total mass of the ink.

* * * * *